US012686957B2

(12) United States Patent
Danaher

(10) Patent No.: US 12,686,957 B2
(45) Date of Patent: Jul. 21, 2026

(54) NON-SEAMED SHEETING FABRIC HAVING A COOL PORTION AND A WARM PORTION

(71) Applicant: Thomas Danaher, New York, NY (US)

(72) Inventor: Thomas Danaher, New York, NY (US)

(73) Assignee: Thomas Danaher, New York, NY (US)

( * ) Notice: Subject to any disclaimer, the term of this patent is extended or adjusted under 35 U.S.C. 154(b) by 0 days.

(21) Appl. No.: 19/062,621

(22) Filed: Feb. 25, 2025

(65) Prior Publication Data

US 2025/0263870 A1 Aug. 21, 2025

Related U.S. Application Data

(62) Division of application No. 15/782,207, filed on Oct. 12, 2017, now Pat. No. 12,385,170.

(60) Provisional application No. 62/407,584, filed on Oct. 13, 2016.

(51) Int. Cl.

| | |
|---|---|
| ***D04B 21/08*** | (2006.01) |
| ***D04B 21/14*** | (2006.01) |
| *A47G 9/02* | (2006.01) |
| *D03D 1/00* | (2006.01) |
| *D03D 13/00* | (2006.01) |
| *D03D 21/00* | (2006.01) |
| *D03D 27/04* | (2006.01) |
| *D03D 27/06* | (2006.01) |

(52) U.S. Cl.

CPC ..... *D04B 21/08* (2013.01); *D04B 21/14* (2013.01); *A47G 9/0238* (2013.01); *D03D 1/0017* (2013.01); *D03D 13/004* (2013.01); *D03D 21/00* (2013.01); *D03D 27/04* (2013.01); *D03D 27/06* (2013.01); *D10B 2503/06* (2013.01)

(58) Field of Classification Search

CPC ..... D04B 21/06; D04B 21/08; D04B 21/10; D04B 21/12; A47G 9/02; A47G 9/0238

USPC ..... 66/192, 195

See application file for complete search history.

(56) References Cited

U.S. PATENT DOCUMENTS

| | | | | | |
|---|---|---|---|---|---|
| 519,101 | A * | 5/1894 | Spooner | D04B 21/18 | D5/47 |
| 2,133,935 | A * | 10/1938 | Johnson | D04B 21/00 | 66/192 |
| 2,800,783 | A * | 7/1957 | Abood | D04B 21/08 | 66/84 R |
| 3,043,124 | A | 7/1962 | Hubbard | | |
| 3,084,529 | A * | 4/1963 | Scheibe | D04B 27/32 | 66/193 |

(Continued)

FOREIGN PATENT DOCUMENTS

| | | |
|---|---|---|
| CN | 2159150 Y | 3/1994 |
| CN | 2239193 Y | 11/1996 |

(Continued)

OTHER PUBLICATIONS

Dual Zone Quilt, available at https://www.sleepsolutions.com.au/couples-dual-zone-summer-quilt.

(Continued)

*Primary Examiner* — Danny Worrell

(74) *Attorney, Agent, or Firm* — Venable LLP

(57) ABSTRACT

A non-seamed sheeting fabric, such as a bed sheet, including a cool portion and a warm portion that is integral with the cool portion. The warm portion is configured to provide greater thermal insulation than the cool portion.

29 Claims, 23 Drawing Sheets

(56) References Cited

U.S. PATENT DOCUMENTS 3,325,832 A * 6/1967 Malicki ..... A47G 9/0238 5/495
3,508,284 A 4/1970 Marquette
3,728,876 A * 4/1973 Richard ..... D04B 39/00 139/383 B
3,782,137 A * 1/1974 Hughes ..... D04B 23/08 428/102
3,835,512 A * 9/1974 Piller ..... D04B 21/165 28/167
3,864,944 A * 2/1975 Jackson ..... D04B 21/14 66/196
4,074,543 A * 2/1978 Schmidt ..... D04B 21/12 66/193
4,103,485 A * 8/1978 Brues ..... D04B 21/18 66/192
4,132,262 A 1/1979 Wibell
4,520,636 A * 6/1985 Schnegg ..... D04B 21/14 66/213
4,608,290 A * 8/1986 Schnegg ..... D04B 23/10 428/101
4,748,078 A * 5/1988 Doi ..... D04B 21/08 66/169 A
4,847,133 A * 7/1989 Foxman ..... B32B 5/026 428/221
4,869,081 A 9/1989 Groshens
4,893,482 A * 1/1990 Frenzel ..... D04B 21/165 66/196
5,007,125 A * 4/1991 Owenby ..... A47G 9/0207 5/482
5,146,634 A 9/1992 Hunt
5,249,320 A 10/1993 Moretz et al.
5,265,445 A * 11/1993 Shytles ..... D04B 21/18 602/76
5,287,573 A 2/1994 Ritacco
5,290,619 A * 3/1994 Siegel ..... D04B 21/16 428/218
D359,871 S 7/1995 Fortran
D379,893 S 6/1997 Dilbeck
5,987,668 A 11/1999 Ackley
6,314,768 B2 * 11/2001 Motoya ..... D04B 21/10 66/195
6,643,872 B1 11/2003 Buswell
7,124,455 B2 10/2006 Demarco et al.
7,201,024 B2 * 4/2007 Hirayama ..... D04B 21/12 66/195
7,566,846 B1 7/2009 Sorensen et al.
8,129,295 B2 3/2012 Aasgaard
8,402,580 B2 3/2013 Walvius et al.
8,566,982 B2 10/2013 Walvius et al.
9,109,309 B2 8/2015 Walvius et al.
9,149,137 B2 10/2015 Liddick
9,474,395 B2 10/2016 Garg et al.
9,788,661 B1 * 10/2017 Alletto ..... A47C 21/042
9,988,745 B2 6/2018 Sanchez et al.
10,060,054 B2 8/2018 Weening et al.
10,244,876 B2 * 4/2019 Alletto, Jr. ..... A47C 21/06
10,531,744 B2 * 1/2020 Alletto ..... A47G 9/0238
11,793,333 B2 * 10/2023 Rahmani ..... A47G 9/0215
2003/0106347 A1 * 6/2003 Kost ..... D04B 21/18 66/195
2005/0273930 A1 * 12/2005 Phillipps ..... A47G 9/0223 5/486
2009/0193584 A1 8/2009 Stewart et al.
2010/0313356 A1 12/2010 Morter
2011/0016631 A1 1/2011 Stewart et al.
2011/0056248 A1 * 3/2011 Suzuki ..... D04B 21/08 66/195
2011/0070412 A1 3/2011 Ly
2012/0017371 A1 1/2012 Pollard
2012/0291495 A1 * 11/2012 Lee ..... D04B 21/10 66/195
2014/0000004 A1 1/2014 Baron et al.
2014/0068868 A1 3/2014 Morzano et al.
2014/0115783 A1 5/2014 Rock et al.
2015/0208815 A1 7/2015 Chandler et al.
2017/0099965 A1 * 4/2017 Alletto, Jr. ..... A47C 31/105
2019/0191897 A1 * 6/2019 Alletto, Jr. ..... D04B 1/102

FOREIGN PATENT DOCUMENTS

CN 2547217 Y 4/2003
CN 1732829 A 2/2006
CN 102240119 A 11/2011
CN 202891256 U 4/2013
DE 3111846 A1 10/1982
FR 2214439 A1 8/1974
GB 2097829 A * 11/1982 ..... D04B 21/14
GB 2330535 A * 4/1999 ..... A01M 1/2022
JP 5737480 A 3/1982
JP 2008289649 A 12/2008
WO 9119443 A1 12/1991
WO WO-2010037082 A2 * 4/2010 ..... A47G 9/02

OTHER PUBLICATIONS

Venus & Mars Quilt—Dual Warmth, available at https://www.tontine.com.au/venus-mars-quilt-dual-warmth.html.
Cuddle Comfortably: Dual Temperature Climate Control, available at https://www.sleepfreshbed.com/dual-temperature-control/.
International Search Report and Written Opinion of the International Searching Authority, PCT/US2017/056301, Feb. 16, 2018 (10 pages).

* cited by examiner

NON-SEAMED SHEETING FABRIC HAVING A COOL PORTION AND A WARM PORTION

FIELD

The present disclosure relates to a non-seamed sheeting fabric having a cool portion and a warm portion.

BACKGROUND

This section provides background information related to the present disclosure, which is not necessarily prior art.

Producing sheeting fabric includes various processes, such as the following: 1) selecting raw materials; 2) specifying yarn attributes (density, twist, etc.); 3) defining fabric construction, such as yarns per inch in warp, weft, wale, and/or course; and 4) determining the suitable weaving (e.g., plain, complex, twill, etc.) or knitting (jersey, tricot, etc.) patterns for the fabric desired.

Most sheeting fabrics have an unchanging continuity across their full width (e.g., they look the same, feel the same, weigh the same, launder the same, etc.), because they are produced the same from one edge of the fabric to the other. The exception is bedding fabrics that have decorative elements, such as narrow stripes or fancier patterns, such as florals woven or knitted into the fabric. However, even in such decorative instances the bedding fabric exhibits generally identical characteristics (e.g., feel, weight, warmth, and laundering behavior) through the full width of the fabric.

The present invention provides for numerous advantages over the art and unexpected results. For example, the present invention advantageously provides for a non-seamed sheeting fabric with significant differences in appearance, feel, density, weight, and warmth between two or more portions of the fabric. For example, some embodiments provide for a non-seamed sheeting fabric with at least one portion having more than twice the weight of the other. The present invention further provides for a finishing process that maximizes the differential effect existing in the fabric to provide significantly different thermal insulation characteristics. The present invention also provides for a non-seamed sheeting fabric which has reduced puckering and/or reduced differential shrinkage after usage and laundering even though the fabric is comprised of different portions having distinct characteristics.

In accordance with the present invention, the non-seamed sheeting fabric may comprise portions having distinct thermal properties, for example, a cool portion and a warm portion. Thermal insulation is affected by the speed and volume of air flowing in proximity to the user. By replacing warmer air with cooler air, body temperature is lowered. Evaporation—nature's primary cooling process, which converts water (perspiration) to vapor—is increased when the speed and volume of air flow increases. There are two different thermal sensation timeframes. The first timeframe is best described as the instant touch temperature. Primarily associated with lightness and pliability, it is the ability of the fabric to move air quicker, more frequently, and with less force or effort. The non-seamed sheeting fabric of this invention preferably utilizes lighter, higher pliability fabric for the cool portion(s) than the warm portion(s). The second timeframe concerns the relatively slow transmission of heat and moisture over extended periods of time, such as overnight. Primarily associated with breathability, it is the ability of a fabric to efficiently transmit heat and moisture vapor through the fabric. Lighter fabrics allow for quicker escape of heat and moisture as a result of increased porosity caused by a higher quantity of and/or larger size of gaps between yarns. Thinner yarns retain less heat and vapor and conduct it away faster than a fabric of coarser yarns. Furthermore, fibers themselves have unique temperature retention and moisture management capabilities that are well known to those skilled in the art. Finally, the provision of a pile (Latin: pilus for "hair") of raised yarn and/or fiber above the surface of a fabric affects the speed of heat and vapor transmission. As described herein, the non-seamed sheeting fabric of this invention utilizes different weights, density, porosity, fiber, and pile variations for the warm and cool portion(s).

SUMMARY OF THE INVENTION

This section provides a general summary of the disclosure, and is not a comprehensive disclosure of its full scope or all of its features. The present invention generally provides for a non-seamed sheeting fabric, such as a bed sheet, including at least one first portion and at least one second portion. The first portion is configured to provide greater thermal insulation than the second portion. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
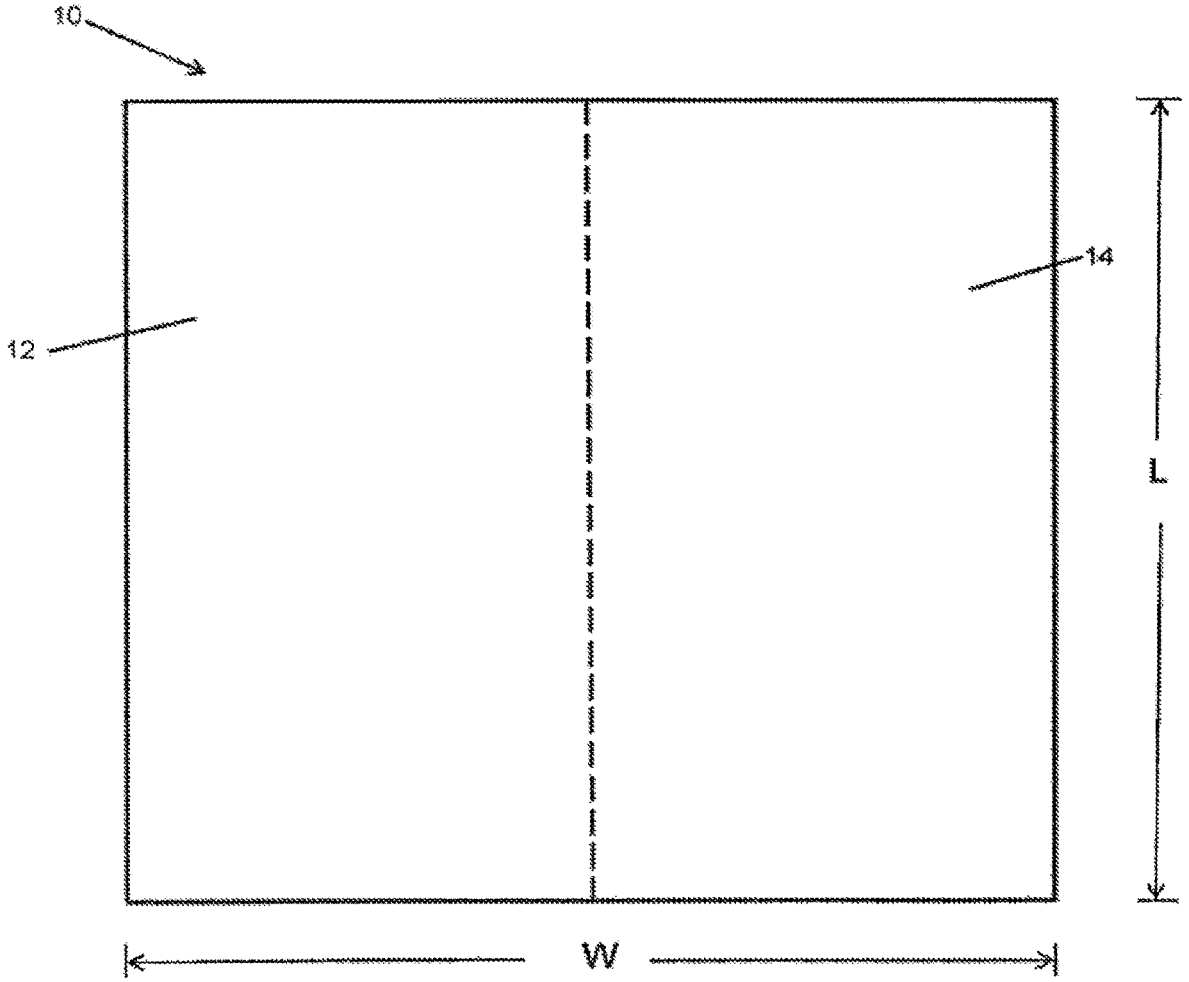
FIG. 1 illustrates an exemplary non-seamed sheeting fabric in the form of a bed sheet including a warm portion and a cool portion, the warm portion is configured to provide greater thermal insulation than the cool portion.

Example embodiments will now be described more fully with reference to the accompanying drawings. With initial reference to FIG. 1, the present invention provides for a non-seamed sheeting fabric 10, such as in the form of a bed sheet, having a warm portion 12 for approximately one-half the width, and a cool portion 14 for the remaining half. It may be beneficial to provide more than half of the non-seamed sheeting fabric 10 as the warm portion 12 and less of the cool portion 14 (or vice versa), and thus the present invention is not limited by any one ratio. The non-seamed sheeting fabric 10 can have more than one section each of the warm and cool portions 12 and 14.

In some embodiments, there is a distinct change from the warm portion 12 to the cool portion 14. In other embodiments, there may be a gradual change from the warm portion 12 to the cool portion 14 by introducing at least one yarn from the cool portion 14 into the warm portion 12 and/or at least one yarn from the warm portion 12 into the cool portion 14. For woven non-seamed sheeting fabrics, some embodiments may include is at least one common warp yarn in both the warm portion 12 and the cool portion 14 whereas other embodiments may include at least one common weft yarn in both the warm portion 12 and the cool portion 14. Additional woven non-seamed sheeting fabrics may include at least one common warp yarn and at least one common weft yarn in both the warm portion 12 and the cool portion 14. For knit non-seamed sheeting fabrics, some embodiments may include is at least one common course yarn in both the warm portion 12 and the cool portion 14 whereas other embodiments may include at least one common wale yarn in both the warm portion 12 and the cool portion 14. Additional knit non-seamed sheeting fabrics may include at least one common course yarn and at least one common wale yarn in both the warm portion 12 and the cool portion 14. In accordance with the present invention, a single fabric comprises at least two portions having distinct characteristics (e.g., a warm portion 12 and a cool portion 14) and lacks a seam connecting the warm portion to the cool portion.

Fabric Construction

The non-seamed sheeting fabric 10 of the present invention can be constructed using any suitable construction techniques and devices, so as to produce a non-seamed sheeting fabric 10 with different thermal characteristics. For example, yarns used for the warm portion(s) 12 are typically thicker or denser than those employed for the cool portion(s) 14. As known in the art, yarns with different textures and/or filament shapes, etc., lend themselves best to either the warm portion 12 or cool portion 14. Similarly, crimped, curved, coarse yarns, yarns with different twists, etc., may be used for the warm portion 12 and/or the cool portion 14. The number of yarns per inch, stitches per inch and/or the number of yarns per loop or stitch, can be higher for the warm portion(s) 12 than the cool portion(s) 14.

Fibers that are preferably warmer, whether plain or treated (such as Columbia's Omni-Heat® Reflective; Schoeller's "Solar+™ and Sympatex Reflexion®), cotton and other warm fibers are preferably used for warm portion(s) 12. Fibers such as linen, lyocell (Tencel), bamboo or cotton yarns (plain or treated such as Rudolf Chemical Group's: Siluran®; Ruco-Pur® Sec, Ruco-Pur® Sly or Ruco-Pur® Sph) are preferably used for cool portion(s) 14. Polyester, polyester microfiber and other synthetic yarns, with or without texturing and/or chemical treatments, can be suitably used for the cool and warm portions 12 and 14.

The non-seamed sheeting fabric 10 may be sheared, brushed or sueded as subsequently disclosed to accentuate the thermal differences of the warm and cool portions 12 and 14.

Woven Construction

Plain Weaves

In some embodiments of the invention, a plain weave, as described herein, may be used for the cool portion 14. As described herein, a plain weave may form a base fabric having equal number of yarns in both the warp and weft directions. In a plain weave, the yarns may vary in thickness, crimp, twist, plies, insularity, density and warmth of the weave. In one embodiment, the plain weave is a relatively low density, airy weave that permits body heat to escape through many gaps between the warp and weft yarns.

In some embodiments, a plain weave may be a single weft yarn crossed by a single warp yarn woven together using what may be known in the art as a one-up-one-down weave, an over under pattern and/or a one-over-one weave. For example, this type of weaving pattern may be achieved when every other warp yarn moves (e.g., yarns A, C, E, G, etc. are lifted while yarns B, D, F, H, etc. are lowered). This weave may also result in the minimum number of yarns per square inch.

In other embodiments, a plain weave may have warp and weft yarns each comprising a group of yarns wherein each group comprises an equal number of yarns. These groups of yarns may be woven together using what may be known in the art as an over under pattern or a basketweave. In some embodiments, a plain weave may comprise a group of two yarns in the warp and a group of two yarns in the weft (e.g., 2/2 plain weave). In some embodiments, the plain weave may comprise a group of three yarns in the warp and three yarns in the weft (e.g., 3/3 plain weave). Other embodiments in accordance with the invention may comprise groups of 4-10 yarns in both the warp and weft directions, for example, 4/4 plain weave, 5/5 plain weave, 6/6 plain weave, 7/7 plain weave, 8/8 plain weave, 9/9 plain weave and 10/10 plain weave.

As the number of yarns in the groups increases, the resulting fabric becomes less resistant to abrasion, exhibits reduced tensile strength, reduced durability, is rougher and an increased tendency to pill. Weaving constructions with more than 10 unsecured yarns in either direction creates quality problems in sheeting and other lightweight fabric as the individual yarns are not sufficiently interlaced with another and have fewer contact points. Yarn bunching, tucking, over/underlaying; over/underlapping and other deformations may occur. More expensive, higher quality, plied, increase or reverse twist or synthetic yarn can partially offset problems caused by the lack of contact points but those skilled in the art recognize the law of diminishing returns and, in general, groups above 8 unsecured yarns are uncommon.

Complex Weaves

In some embodiments of the invention, a complex weave, as described herein, may be used for the warm portion 12. As described herein, complex weaves may form a base fabric having groups of float yarns and covered (sunken) yarns, wherein each group comprises an unequal amount of yarns. In a complex weave, the yarns may vary in thickness, crimp, twist, plies, insularity, density and warmth of the weave. In some embodiments, a relatively low number of interlocking yarns allows more yarns to be packed close together into a given area, increasing the fabric weight and density. This is a generally warmer weave as body heat is restricted by the reduced size and quantity of gaps between the warp and weft yarns.

In some embodiments, a complex weave is where the warp yarns are floated over the weft yarns, which may be known as a warp-faced complex weave, which extends along the length of the fabric. For example, a complex weave may be wherein four warp yarns are floated over one weft yarn, which is known as a sateen weave, a 4/1 complex weave or a four-over-one (e.g., yarns A, F, K, P, etc. are lifted while yarns B,C,D,E; G,H,I,J; L,M,N,O; etc. are lowered). In another embodiment, a complex weave in accordance with the invention may have five warp yarns floated over one weft yarn, also known as a 5/1 complex weave. Other embodiments in accordance with the inventions may have about 6 to 10 warp yarns, such as a 6/1 complex weave, 7/1 complex weave, 8/1 complex weave, 9/1 complex weave or 10/1 complex weave.

In some embodiments, a complex weave is wherein the weft yarns are floated over the warp yarns, which may be known in the art weft-faced weaves which extends along the width of the fabric. For example, a complex weave in accordance with the present invention may be wherein four weft yarns are floated over one warp yarn, which is known as a 1/4 complex weave. In another embodiment, a complex weave may be wherein five weft yarns are floated over one warp yarn, also known as a 1/5 complex weave. In other complex weaves in accordance with the invention, there may be about 6 to 10 weft yarns, such as a 1/6 complex weave, 1/7 complex weave, 1/8 complex weave, 1/9 complex weave or 1/10 complex weave.

In some embodiments, a complex weave can also be produced with groups of float yarns interlaced or interwoven with groups of covered or sunken yarns. In some embodiments, the number of float yarns versus sunk yarns can be three (e.g., 5/2 complex weave, 6/3 complex weave, 7/4 complex weave, 8/5 complex weave, 9/6 complex weave, 10/7 complex weave, 2/5 complex weave, 3/6 complex weave, 4/7 complex weave, 5/8 complex weave, 6/9 complex weave, or 7/10 complex weave); four (6/2 complex weave, 7/3 complex weave, 8/4 complex weave, 9/5 complex weave, 10/6 complex weave, 2/6 complex weave, 3/7 complex weave, 4/8 complex weave, 5/9 complex weave, or 6/10 complex weave); five (7/2 complex weave, 8/3 complex weave, 9/4 complex weave, 10/5 complex weave, 2/7 complex weave, 3/8 complex weave, 4/9 complex weave, or 5/10 complex weave); six (8/2 complex weave, 9/3 complex weave, 10/4 complex weave, 2/8 complex weave, 3/9 complex weave, or 4/10 complex weave); seven (9/2 complex weave, 10/3 complex weave, 2/9 complex weave, or 3/10 complex weave) or eight (10/2 complex weave or 2/10 complex weave).

Figure 3:
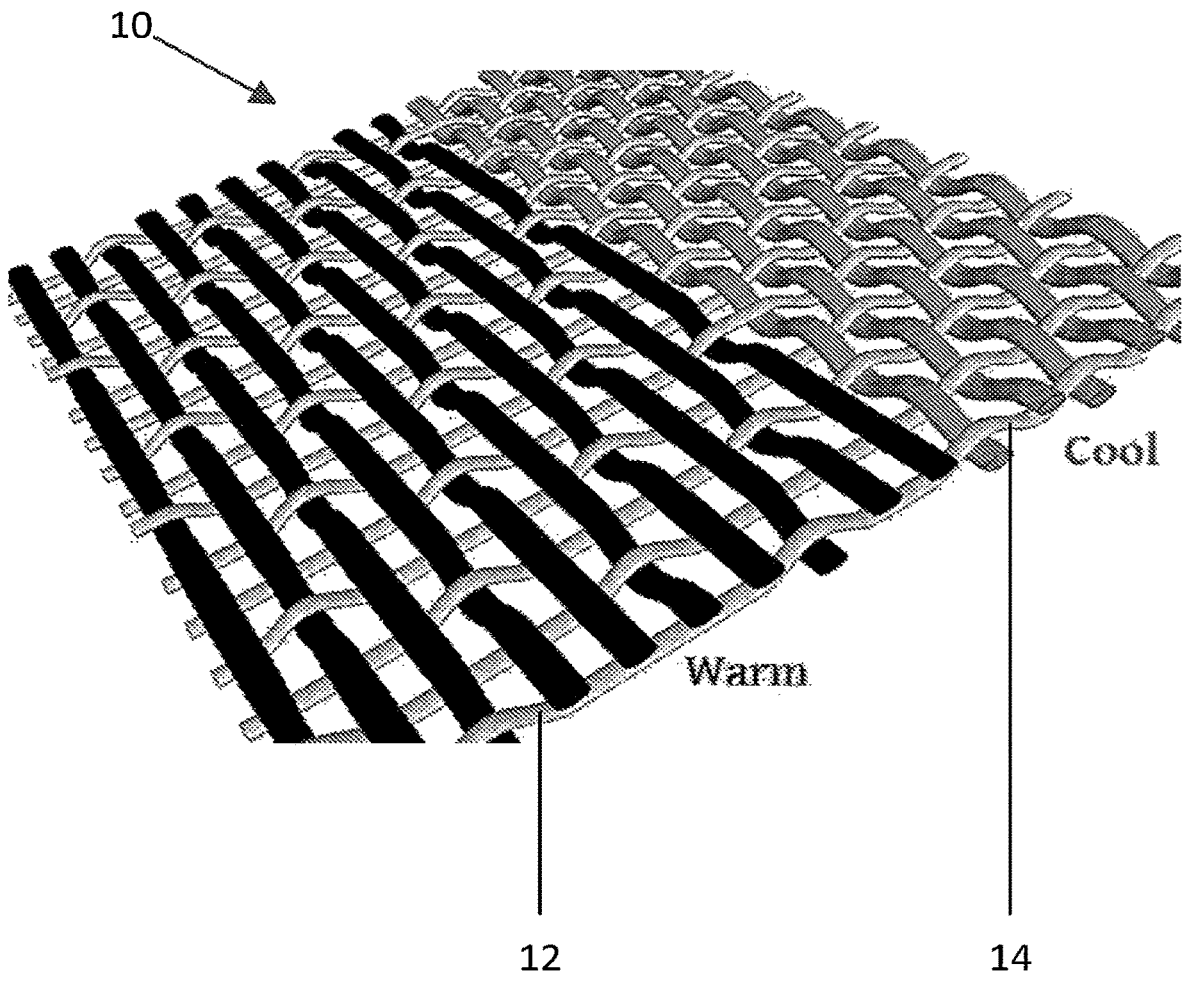
FIG. 3 is a perspective view of the woven sheet in accordance with the present invention.

According to one preferred embodiment of the invention, the non-seamed sheeting fabric includes a cool portion 14 comprising a plain weave and a warm portion 12 comprising a complex weave wherein there is at least one common warp and/or weft yarn. In another preferred embodiment, as shown in FIG. 3, the non-seamed sheeting fabric includes a cool portion 14 comprising a 1/1 plain weave and a warm portion 12 comprising a 4/1 complex weave wherein there is at least one common warp and/or weft yarn. According to some embodiments, each of the warm and the cool portion have different densities. In some embodiments, the warm portion may have a higher density compared to the cool portion. In other embodiments, the cool portion may have a higher density than the warm portion. The difference in density between the warm portion 12 and cool portion 14, may be based on the construction of the weaves used in each portion as well as the yarn and fiber characteristics used in each portion.

By providing at least one common warp or weft yarn, this allows for the fabric to have at least two distinct portions with a reduction in puckering and/or reduced fabric distortion due to differential shrinkage. As used herein, a reduction in puckering is when the fabric having two distinct portions (e.g., warm portion and cool portion) has a less rippled appearance or fewer wrinkles/folds at the junction of the two portions. According to the present invention, the non-seamed fabric sheet having a common warp and/or weft yarn allows for a more even feel across the fabric and a more consistent appearance when in use.

In another embodiment in accordance with the present invention, a version of weft-faced complex weave is woven with a version of plain weave to create alternating horizontal bands that extend generally across the width of the non-seamed sheeting fabric 10. The pattern of alternating bands repeats throughout the length of the non-seamed sheeting fabric 10 and are sized approximately half the width of the finished sheet. For example, a 70×100 sheet may include a 35 inch band of a weft-faced complex weave and a 35 inch band of a plain weave across the fabric. During production, the fabric is rotated 90° and the 100 inch width of the fabric becomes the length of the sheet. The alternating horizontal bands provide now-vertical warm portion 12 and cool portion 14 of the non-seamed sheeting fabric 10.

Inclusion of Multiple Weaving Patterns

Figure 5:
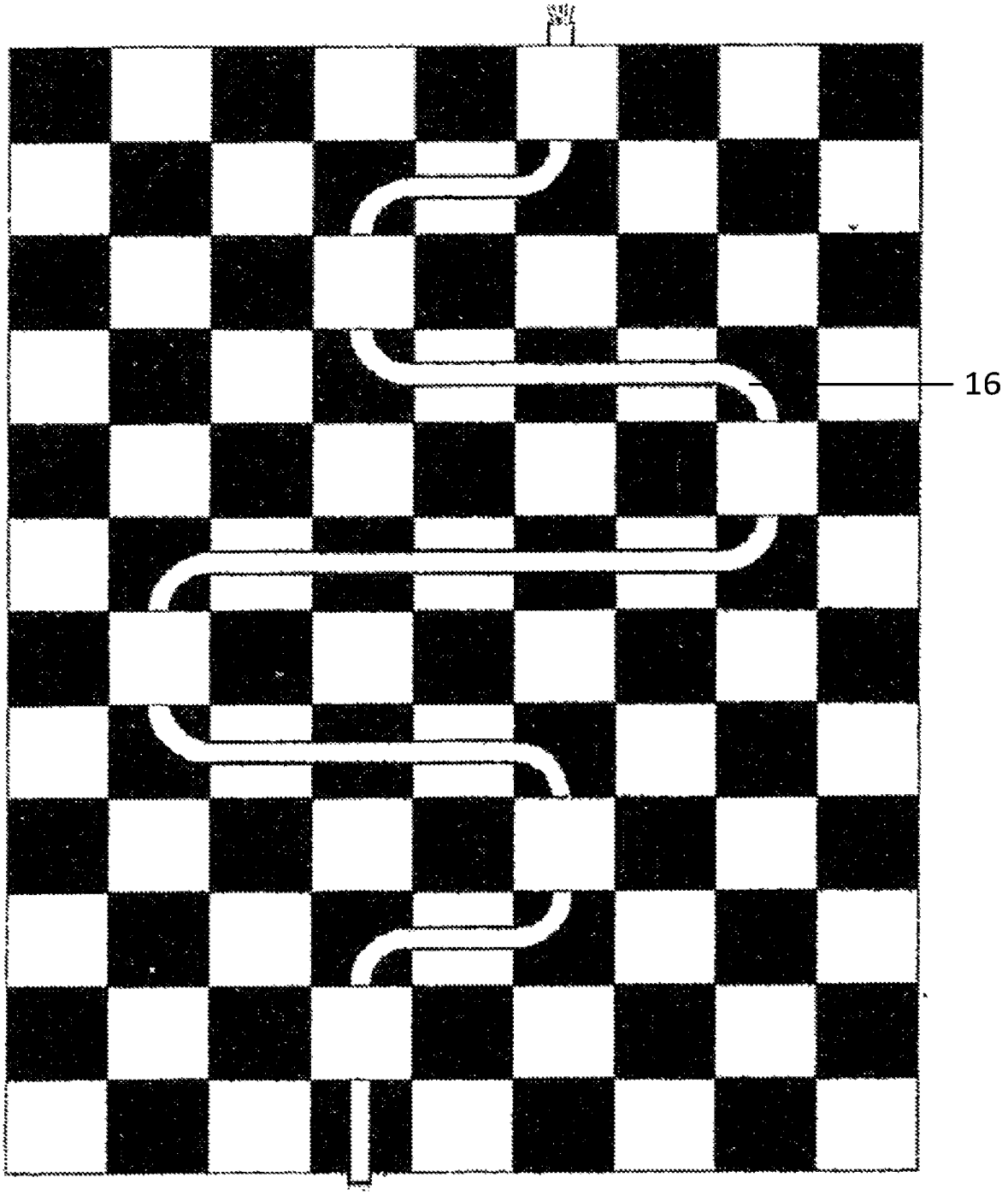
FIG. 5 illustrates a lappet weave in accordance with the present invention.
Figure 6A:
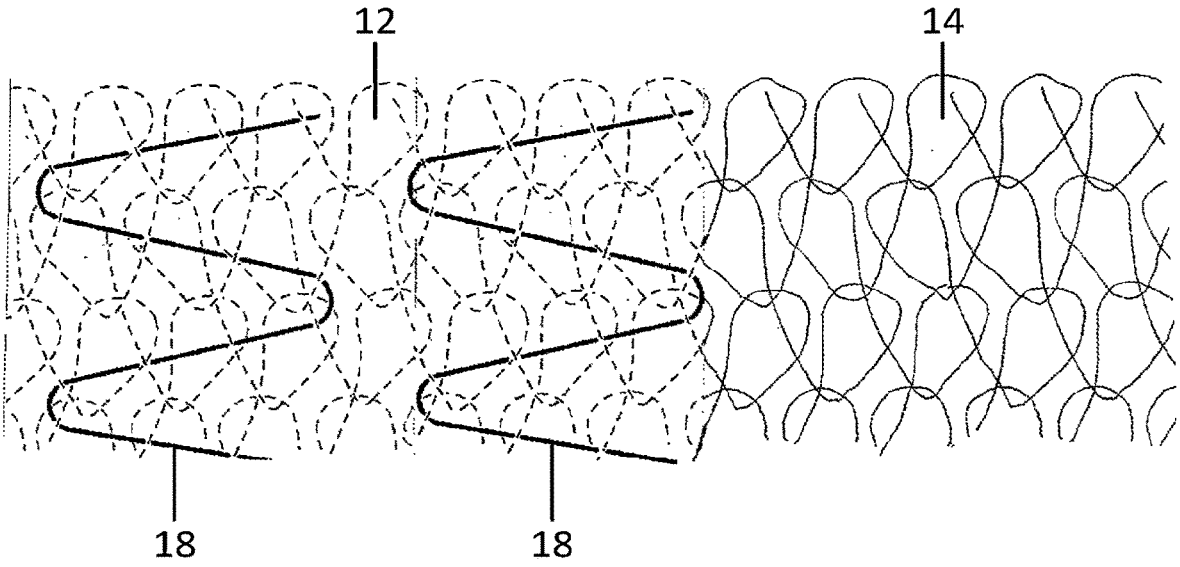
FIGS. 6A-6D are each plan views of knit sheets according to the present invention having in-laid or sliver yarn.
Figure 6B:
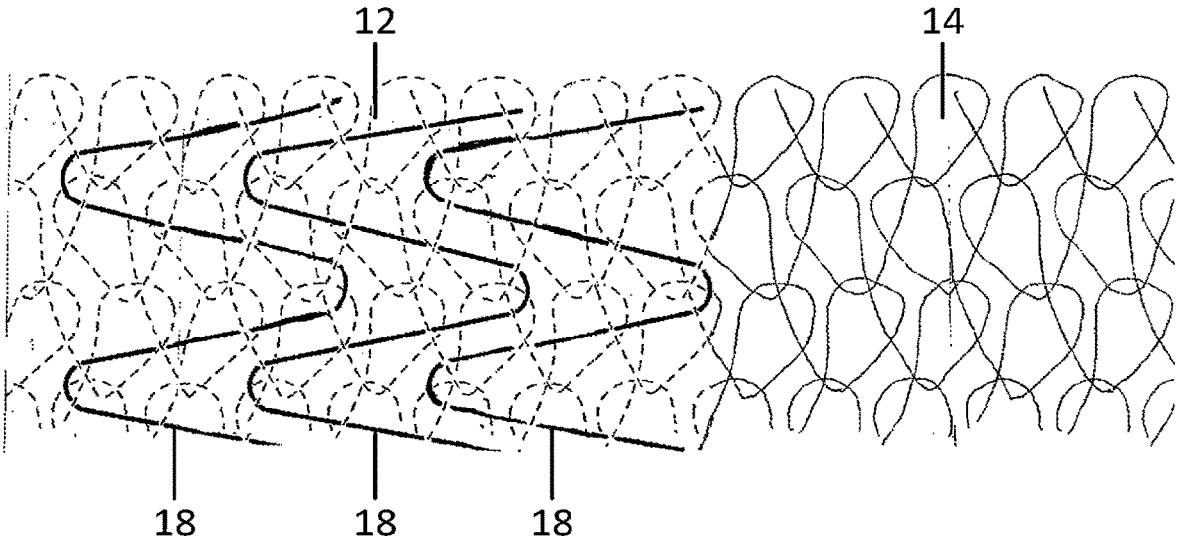
Figure 6C:
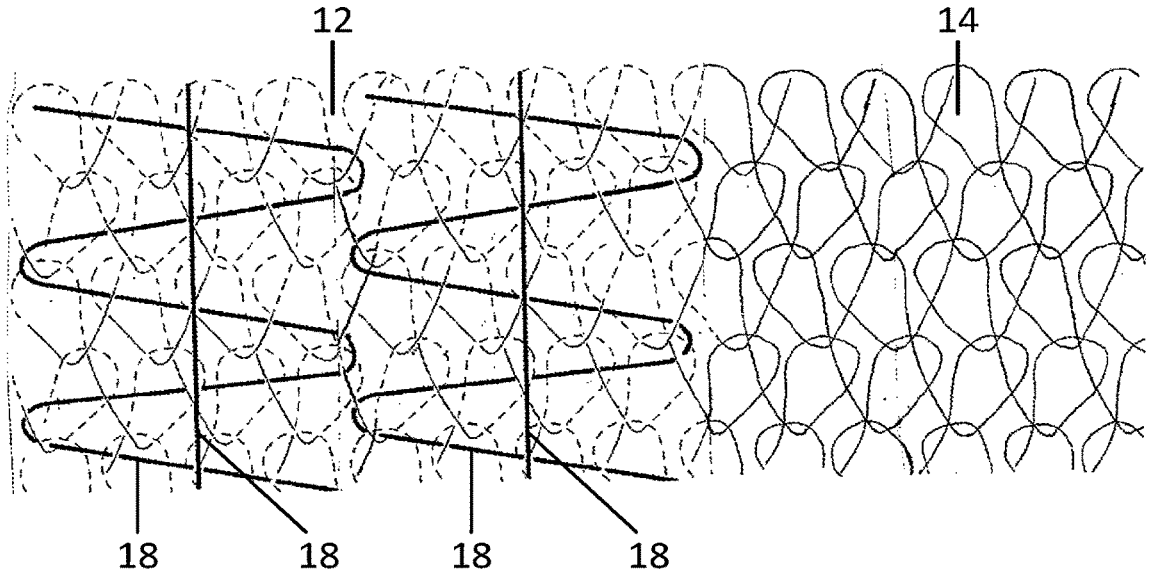
Figure 6D:
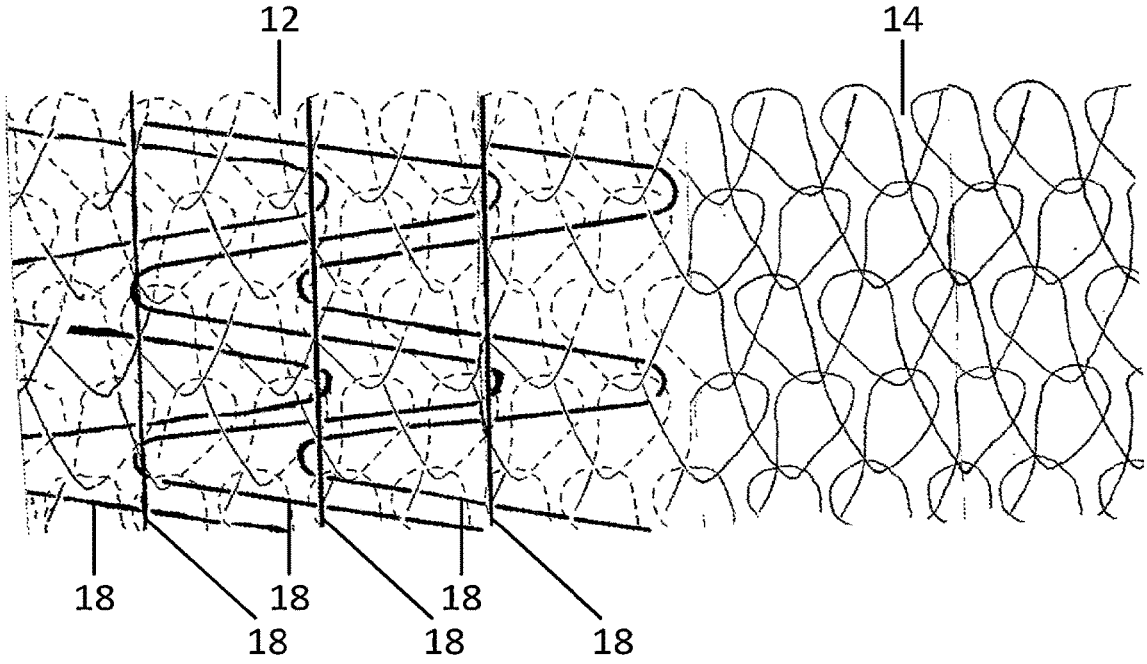

The present invention provides for using more than one weaving patterns in various portions of the non-seamed sheeting fabric 10. According to one embodiment, additional yarns may be interlaced into the base fabric using surface figure weaves such as lappet weaves, twill weaves, swivel weaves, or clip-spot weaves. As shown in FIG. 5, lappet weaves are formed by extra yarns 16 in the warp direction carried by needles set in a bar in front of the reed; the additional yarns 16 are moved to interlace with the weft yarns. By combining two or more weaving patterns, the various portions of the sheet may show increased strength, weight, density and thermal characteristics compared to portions having only a single weaving pattern. In another embodiment, the plain weave as described herein may be combined with a twill weave, a lappet weave, swivel weaves, clip-spot weaves and combinations thereof. In a further embodiment, the complex weave described herein may be combined with a twill weave, a lappet weave, swivel weaves, clip-spot weaves and combinations thereof. Jacquard looms, which can move individual warp yarns in almost unlimited variations, allow for mixing a multitude of various weaving patterns in a single fabric. The present invention provide for use of any suitable weaving patterns in addition to those specifically mentioned herein.

Inclusion of Additional Warp Yarns

The present invention encompasses the utilization of at least one additional warp yarn, also referred to as "stuffer" warp yarn(s), that may further be added without interlacing into the base fabric to add weight, warmth and stability preferably to the warm portion(s). Warp pile weaving (discussed further herein) uses several further methods of interlacing the additional yarn(s) with the base fabric.

Separate Recipes

Figure 2A:
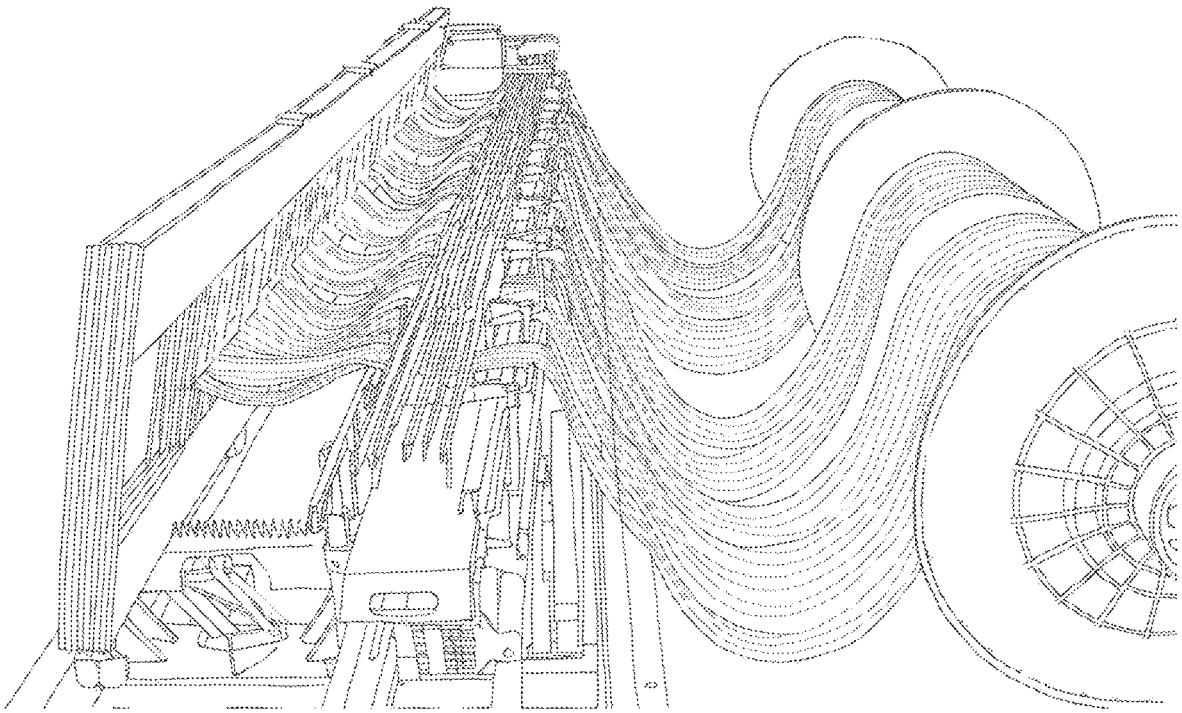
FIG. 2A shows a portion of an exemplary weaving machine according to the present invention where the warp yarns of the two beams are passed through the droppers, heddles, and the reed (this is the phase when the two warp beams are "gathered" and start working as a single warp beam)
Figure 2B:
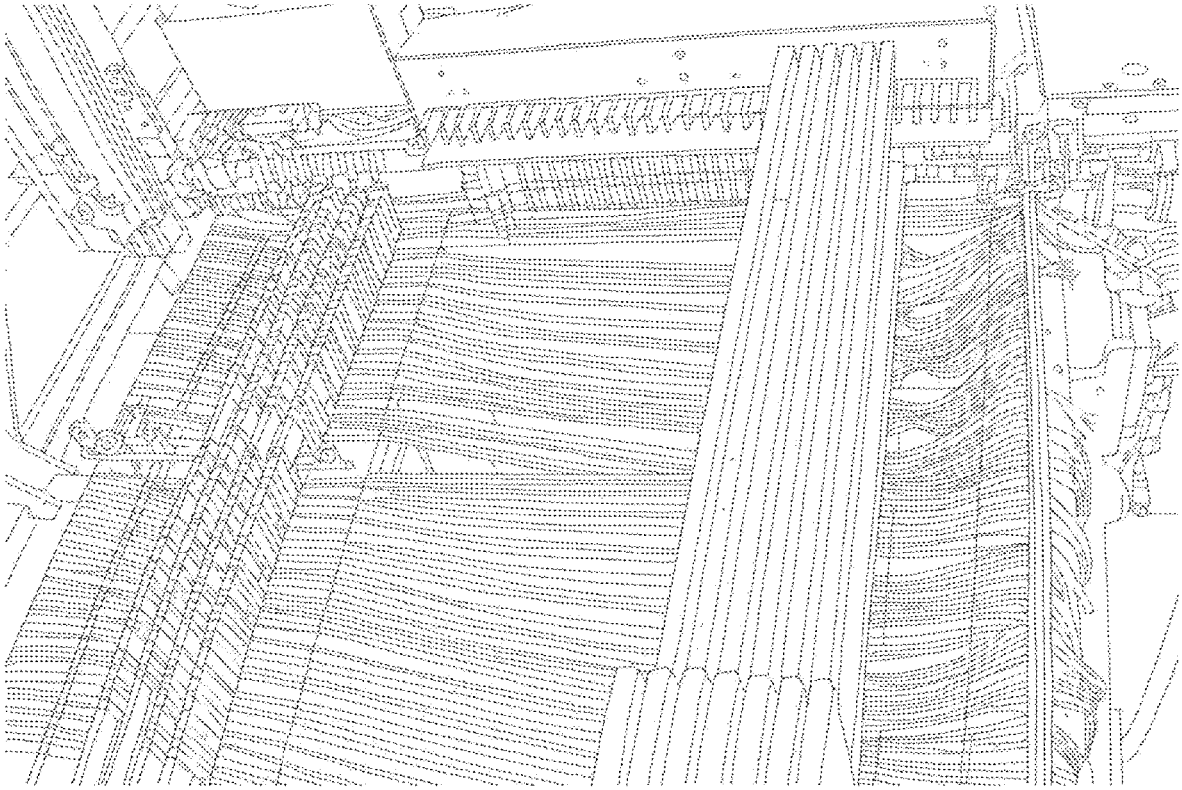
FIG. 2B and FIG. 2C show an exemplary weaving machine according to the present invention.
Figure 2C:
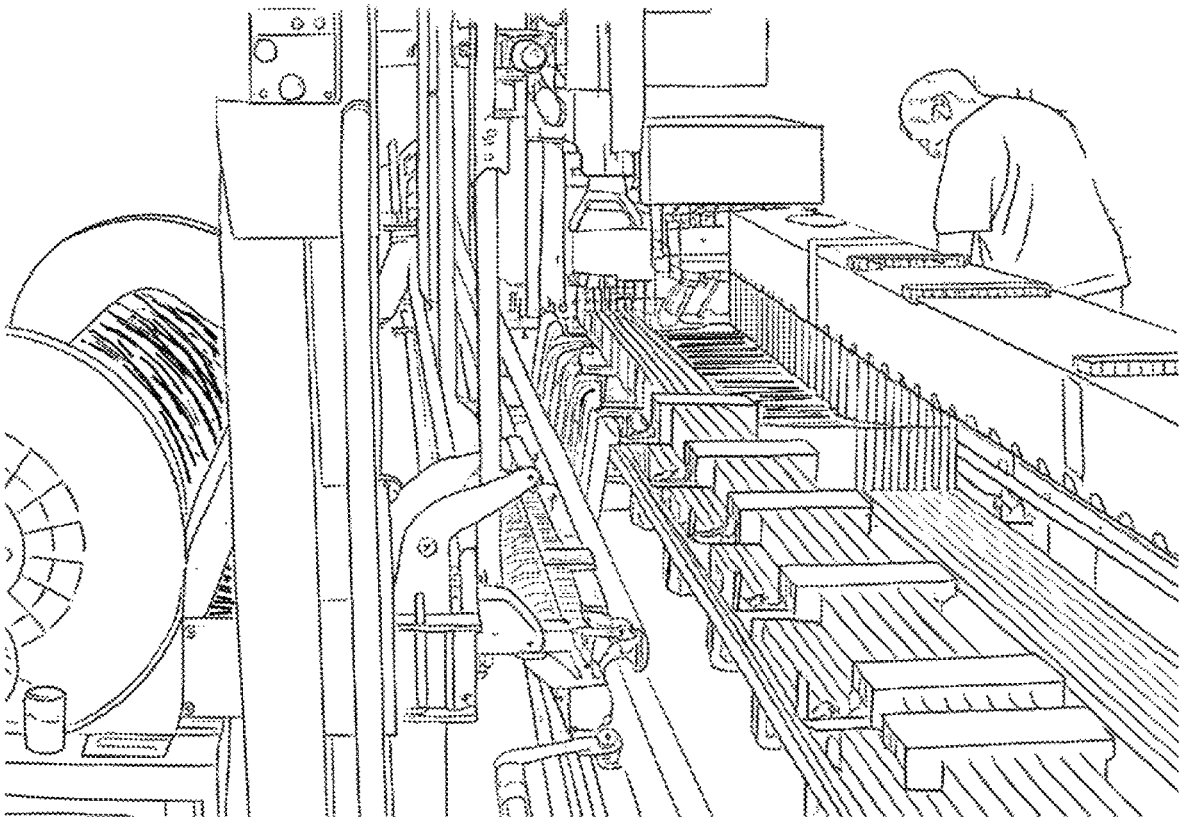

Prior art teaches that specific configurations of chemical and mechanical recipes alter the qualities of the yarn and can change the characteristics of the fabric. For example, yarns are regularly treated to withstand stresses from weaving and other production processes; to enhance strength and separation; to prevent fibers from loosening, and other benefits. An exemplary embodiment of the present invention includes the fabric 10 formed by weaving three sets of yarn, interlacing one set for the weft with two sets for the warp. An exemplary weaving machine according to the present invention is illustrated in FIGS. 2A-2C. The machine includes two warp beams placed substantially parallel and adjacent to one another, which are later united in the weaving process. The provision of two substantially adjacent warp beams allows for the yarns of the warm portion(s) 12 themselves to be different (as previously described) than the cool portion(s) 14. The advantageous utilization of two separate warp beams further allows for the yarns to be processed separately using different recipes for the warm and cool portions 12 and 14.

The present invention also provide for a single warp beam treated with the same recipe yet with separate portions for warm and cool portions using suitably thick or thin warp yarns, more or fewer yarns, yarns of different twists or plies, different fibers, etc., for the warm and cool portions 12 and 14. As is known to those skilled in the art, mounting the different yarns in the creel (yarn rack) before drawing them onto the warp beam provides different yarns in a single warp beam. Same-recipe warp yarns can suffer production disadvantages from higher fabric defects, yarn breakage and production stoppages.

Weaving and CAD Instructions for Loom

Whether two warp beams are placed substantially parallel and adjacent to one another and work as a single warp beam, or a single beam is used, the next process is identical. Individual warp yarns are "drawn in" through components of the loom (droppers, heddles suspended from shafts or harnesses, reed) which control the yarn movement. The movement of the shafts lifts or lowers the warp yarns before the loom passes ("inserts") one or more weft yarns across the warp yarns. The loom then reverses the positions of the warp yarns-those previously lifted are lowered and those previously lowered are lifted-before insertion of the next weft yarn(s). The reversing of the positions prior to the weft insertions is repeated continually and results in a woven fabric. The lifting/lowering of the warp yarns prior to the weft insertion follows a predetermined sequence and defines the weaving pattern of the fabric.

Figure 4:
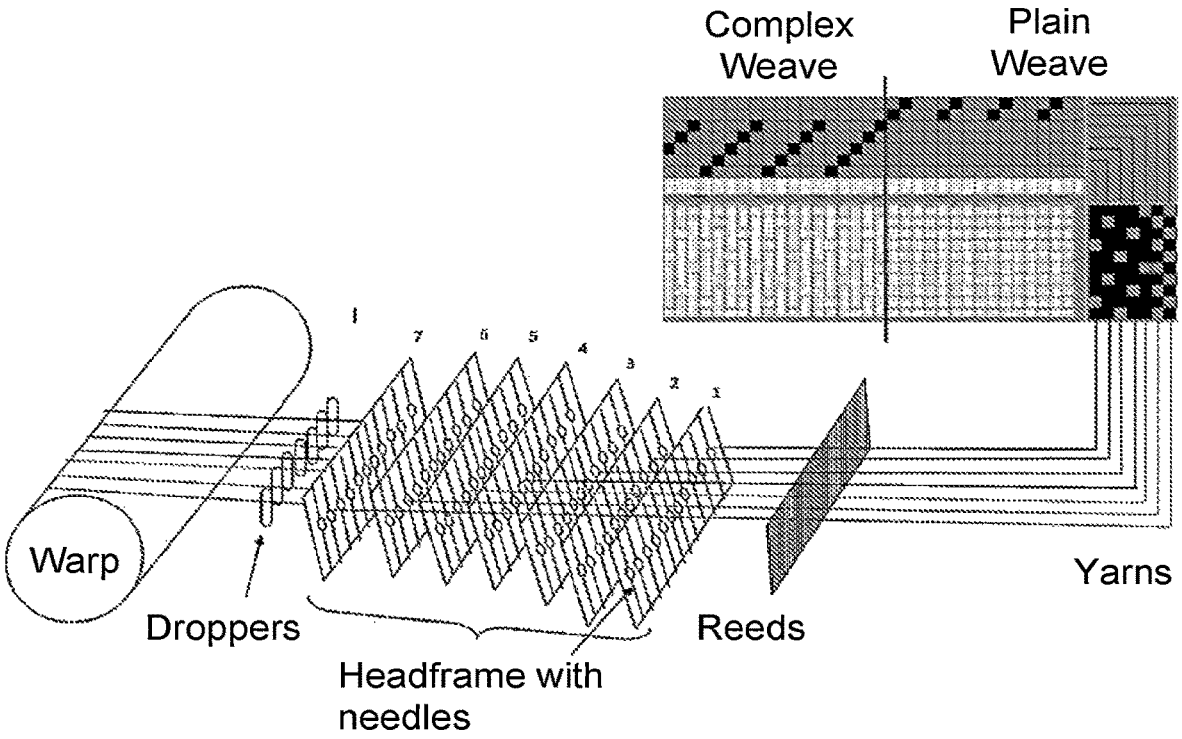
FIG. 4 illustrates components of an exemplary weaving machine according to the present invention and exemplary CAD instructions configured to command the weaving machine to manufacture a fabric sheet according to the present invention.

The weaving patterns described above, as well as any other suitable weaving patterns, are translated into the machine language of the loom using any suitable CAD instructions. FIG. 4 includes an exemplary CAD drawing of instructions for a combined weaving pattern causing the loom to move the warp yarns in a predetermined sequence to simultaneously weave half the non-seamed sheeting fabric 10 in 4/1 complex weave for the warm portion 12 and, the remaining half in 1/1 plain weave for the cool portion 14.

Pile Construction

The present invention further provides for differentiating the appearance, feel, density, weight, warmth and other characteristics of the warm portion 12 and cool portion 14 by introducing at least one separate additional yarn into the plain weave and/or the complex weave to form a pile or tuft above the surface of the base fabric and does not form part of the base fabric composition. A pile may also be added to the knit embodiments as disclosed herein. The present invention advantageously provides for additional yarn or yarn hair oriented in an approximately parallel relation to the base fabric. This is a significant advantage as the added yarn(s)—whether cut or uncut, brushed or unbrushed, sueded or unsueded, formed in pile as yarn or yarn hair—easily yields in "friendly" alignment with the base fabric when weight from a user is applied. Isotropically oriented (oriented in an approximately perpendicular relation to the base fabric) yarn or pile can randomly act as tiny "hostile" pins to prick the user when moving or applying weight. One skilled in the art will appreciate how weak single yarn or fiber hair can exhibit the strength of steel when aligned in a particular orientation. With literally hundreds of thousands of yarns or yarn hairs in contact with the user, random pinpricking is especially noticeable when the weight of the user is applied to the fabric, for example during extended steady-state timeframes such as while sleeping. Finally, yarn(s) or yarn hair raised isotropically, whether crimped, curved, bent or straight is sensitive to crushing or flattening when subjected to user weight and humidity and special care must be exercised in cleaning.

As known to those skilled in the art, in addition to knitting (described below) there are two basic types of weaving a pile fabric: (1) warp pile, which has at least one extra set of warp yarns; and (2) weft pile, which has at least one extra set of weft yarns. Pile fabrics may be sheared, brushed or sueded, as subsequently disclosed, to accentuate the thermal differences of the two portions of the fabric.

Warp Pile Weaving

Various methods and devices incorporating more than one additional yarn can be used to produce a warp pile weave. In the slack tension method, which is used for terry cloth, a second warp beam introduces at least one additional set of yarn to produce the pile loops that interlace with the base fabric. The loops, which can be drawn to one or both sides of the fabric, can also be made higher or lower and/or denser from one side to the other for the warm portion 12 and cool portions 14 of the non-seamed sheeting fabric 10. The loops are preferably partially or fully cut to form the pile in a subsequent shearing process to form a field of fibers oriented generally perpendicular to the base of the fabric. For one embodiment of the present invention, the warm portion(s) 12 has loops but the cool portion(s) 14 has relatively few or none The base fabric may have warm and cool portions as disclosed herein. For example, the complex weave of the warm portion may comprise loops whereas the cool portion is the plain weave as described herein without any additional warp yarns and instead consist only of the base fabric.

An additional warp pile method is used for blankets and most velvet. It employs five sets of yarns to produce a double cloth fabric. Two sets of warp yarns interlace with the weft yarn to weave one fabric above the other face-to-face on the same loom, with the fifth warp yarn interlacing both fabrics. The double cloth is cut apart on the loom to yield two continuous lengths of fabric with the pile formed by the set of cut warp yarns that interlace the two fabrics. With respect to the present invention, interlacing warp yarns are used primarily in the warm portion(s) 12, and the cool portion(s) 14 has relatively few or no interlacing warp yarns. For example, the complex weave of the warm portion may further comprise interlacing warp yarns whereas the cool portion is the plain weave as described herein without any additional interlacing warp yarns. The present invention also includes double-faced fabrics made with three or four sets of yarns to create the separate layers of fabric, and a further adaption whereby two continuous lengths of interlacing fabric create the warm portion(s) 12, but a single face fabric without interlacing creates the cool portion(s) 14. In this last version, the warp beam holds yarn for the warm portion(s) 12, but not the cool portion(s) 14.

Another warp pile used for velvet with cut and uncut portions, utilizes an extra set of warp yarns in an over-wire arrangement. After a number of weft yarns are inserted, a special wire is interlaced instead of a weft yarn and a set of extra warp yarns are passed over the wire to create the loops. After several more warp yarns are inserted beyond the wire rod, the rod is removed. The wire has a sharp knife that cuts the loop as it is withdrawn, partially or fully cutting the loops to form a pile. In the fabric according to the present invention, the set of extra warp yarns is used for the warm portion(s) and the cool portion uses relatively few or none. For example, the complex weave of the warm portion may further comprise an extra set of warp yarn in an over-wire arrangement whereas the cool portion is the plain weave as described herein without an extra set of warp yarns.

Weft Pile Weaving

The present invention further provides for producing the non-seamed sheeting fabric 10 by weft pile weaving, which is used to produce corduroy. In weft pile weaving, at least two sets of weft yarns and one set of warp yarns are used. The additional set of weft yarns float, unsecured by interlacing, over a group of warp yarns. The floating weft yarns are then partially or fully cut to produce the pile. As described for weft-faced weaves, the warm and cool portion(s) 12 and 14 are woven in wide repeating stripes that are sized approximately to half the width of the finished non-seamed sheeting fabric 10. When rotated 90°, these wide stripes become the respective warm and cool portion(s) 12 and 14 and the width of the fabric becomes the length of non-seamed sheeting fabric 10. The warm portion(s) 12 uses floats scattered over the base fabric. The cool portion(s) 14 of the fabric utilizes fewer, shorter, or no floats. The yarns used for the cool portion 14 are preferably thinner, lighter, of higher twist and/or ply and/or utilize cooler fiber as previously disclosed. Furthermore, warm and cool portions 12 and 14 may both be woven with floats scattered over the base fabric with the warm portion(s) cut with a higher pile than the cool portion(s).

In accordance with the present invention, some of the distinct characteristics of the non-seamed sheeting fabric are achieved by using different weaves in the warm portion 12 (e.g., complex weave) and the cool portion 14 (e.g., plain weave). However, as described herein, these differences can be further accentuated through adding a warp pile or weft pile especially into the warm portion of the non-seamed sheeting fabric. It is also noted that, because the difference between the warm and cool portion(s) of a warp or weft pile fabric is achieved primarily by the height and density of the pile, the formation of the base fabric in these embodiments can be significantly simplified. For example, the yarns of the base fabric can be treated with identical recipes through the full width of the fabric and the need for separate recipes for warm and cool portions can be eliminated. The present invention provides, however, for pile weaving also utilizing separate recipes for either single or multiple warp beams and for single or multiple types of weft yarns.

Knitting

The present invention also provides for producing a non-seamed sheeting fabric 10 by knitting, whereby one or more sets of yarns are interlooped to form the fabric structure. Any suitable knitting machine can be used. For example, knitting can be performed on flatbed machines, in which the yarn is carried back-and-forth or on circular machines where the yarn is carried in a spiral to create a tube, which is cut later to provide an essentially flat continuous length of fabric.

Fabric density in knitting is defined by the number of stitches in a specific direction. In a knit fabric, wales are vertical columns of stitches, and courses are the horizontal rows. Fabric density is designated as wales by courses. As with their woven counterparts, the density of knit fabrics can be adjusted by using different yarn weights; yarn twists and piles; numbers of yarns in the stitch(es); fiber(s) used to make the yarns, etc. In accordance with the present invention, the warm portion 12 may have a higher density compared to the cool portion 14.

Fabric weight, density and warmth can also be augmented by introducing additional yarns into knit fabric as will be disclosed herein. Knit fabrics can have loops drawn to one side or both sides of the fabric and with different heights from one side to the other. Knit fabrics may be sheared, brushed or sueded as described below, to accentuate the thermal differences of the two portions of the fabric.

Knits may offer several notable advantages over their woven counterparts, such as the provision of numerous options of highly diverse stitches and yarn patterns as well as the ability to add an in-laid or sliver yarn(s). The utilization of different combinations of stitches and yarn patterns affects the fabric density and other attributes that change the thermal characteristics of the fabric. For example, stitches that create higher porosity fabrics permit more heat and moisture vapor to escape are used preferably for the cool portion(s) 14; less porous stitches that restrict such escape are used preferably for the warm portion(s) 12. Stitches that use more yarn are denser or heavier and are used preferably for the warm portion(s) 12. The warm portion(s) 12 of the non-seamed sheeting fabric 10 can also utilize stitches with increased stretch to provide a closer-to-the-skin, "snug" experience that is generally associated with warmness because the volume of moving air is reduced in such close environments. Further, the cool portion(s) can be knit with occasional needles skipped so less yarn is used and open spaces are created than the warm portion(s) of this invention.

The knits in accordance with the invention may be warp knits, raschel knits, double knits, jersey knits or other knits made on a circular knit machine. In one embodiment, the sheeting fabric 10 in accordance with this invention is a double knit. In another embodiment, the sheeting fabric 10 in accordance with the invention is warp knit. In yet another embodiment the sheeting fabric 10 in accordance with the invention is a raschel knit. In still another embodiment, the sheeting fabric 10 in accordance with the present invention may include more than one type of knit, such that the cool portion 14 may be selected from a warp knit, a raschel knit, a double knit or a jersey knit and the warm portion 12 may differ from the cool portion and such knit may be selected from a warp knit, a raschel knit, a double knit or a jersey knit. In accordance with the invention, a tricot stitch, an interlock stitch and/or simplex stitch constructions may be used. In some embodiments, monofilament yarns are utilized for both warp and circular knit machines. In other embodiments, staple based yarns can be utilized.

Both circular and flatbed machines produce warm and cool portion(s) 12 and 14 in a non-seamed sheeting fabric 10 by altering the components disclosed in what is now a familiar repetition: the thickness or density of yarns; the twist and/or ply in the yarns; the number of individual yarns included in the stitches; the height of the loop stitch; the tightness of the knit (number of stitches per inch); the fiber(s) used in the yarns, etc. Circular machines are currently limited in diameter to produce fabric widths of 90 inches or less. To provide for sheets that require wider width fabrics, the warm and cool portion(s) 12 and 14 are knitted in a single fabric 10 and then attached to additional fabric as disclosed in U.S. Pat. Nos. 8,402,580 B2; 8,566,982 B2 and 9,109,309 B2.

Laid in Yarn

Knit machines, like their woven counterparts, can also be adapted to provide for the introduction of additional yarn(s) into the fabric. As used herein, the terms laid in yarn, in-laid yarn and sliver yarn all refer to yarns that are picked up by the knitting needles along with the base or ground yarns and locked into place as the stitch is formed. In some embodiments in accordance with the invention, the non-seamed sheeting fabric includes a warm portion 12 and a cool portion 14, wherein the warm portion comprises a greater number of sets of in-laid or sliver yarns compared to the cool portion. As used herein, a set of in-laid yarns are in-laid yarns oriented parallel to the base fabric wherein the set may be in a horizontal, vertical and/or diagonal directions wherein each set of yarns may comprise one or more sliver yarns. Warp knit machines can be adapted to introduce up to additional six additional sets of yarn. Flat bed or needle bar knitting machines can lay in yarns crosswise (weft insertion) or lengthwise (warp insertion); still other knit machines lay in yarns on a diagonal. Extra yarns can be fed into the fabric at any point along the diameter of a circular knitting machine. The fibers that form the in-laid or sliver yarn include different properties to provide various options in the fabric regarding thickness, density, durability, warmth, softness, etc.

Figure 15:
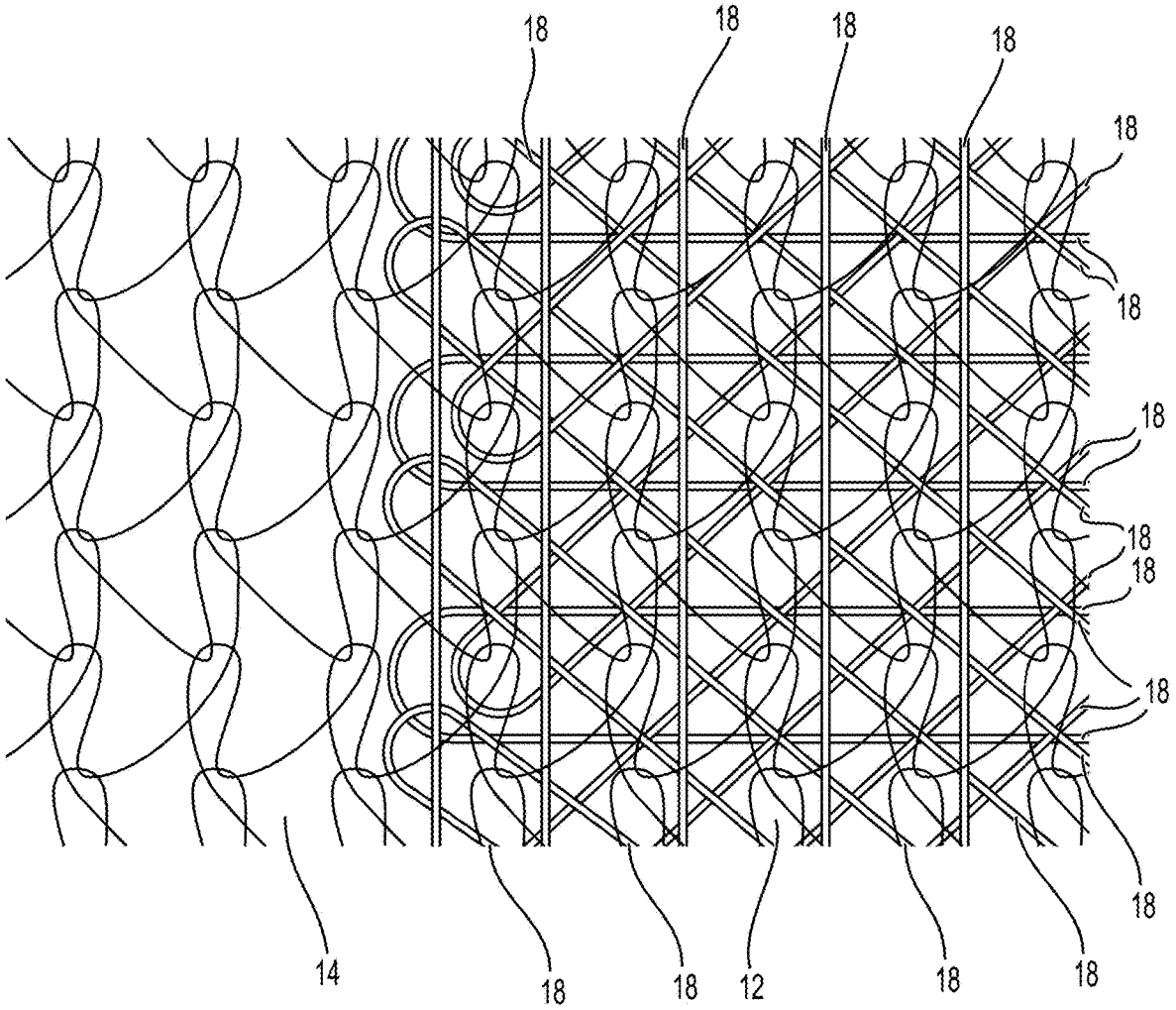
FIG. 15 illustrates a knit sheet according to the present invention having multiple sets of in-laid or sliver yarns.
Figure 16:
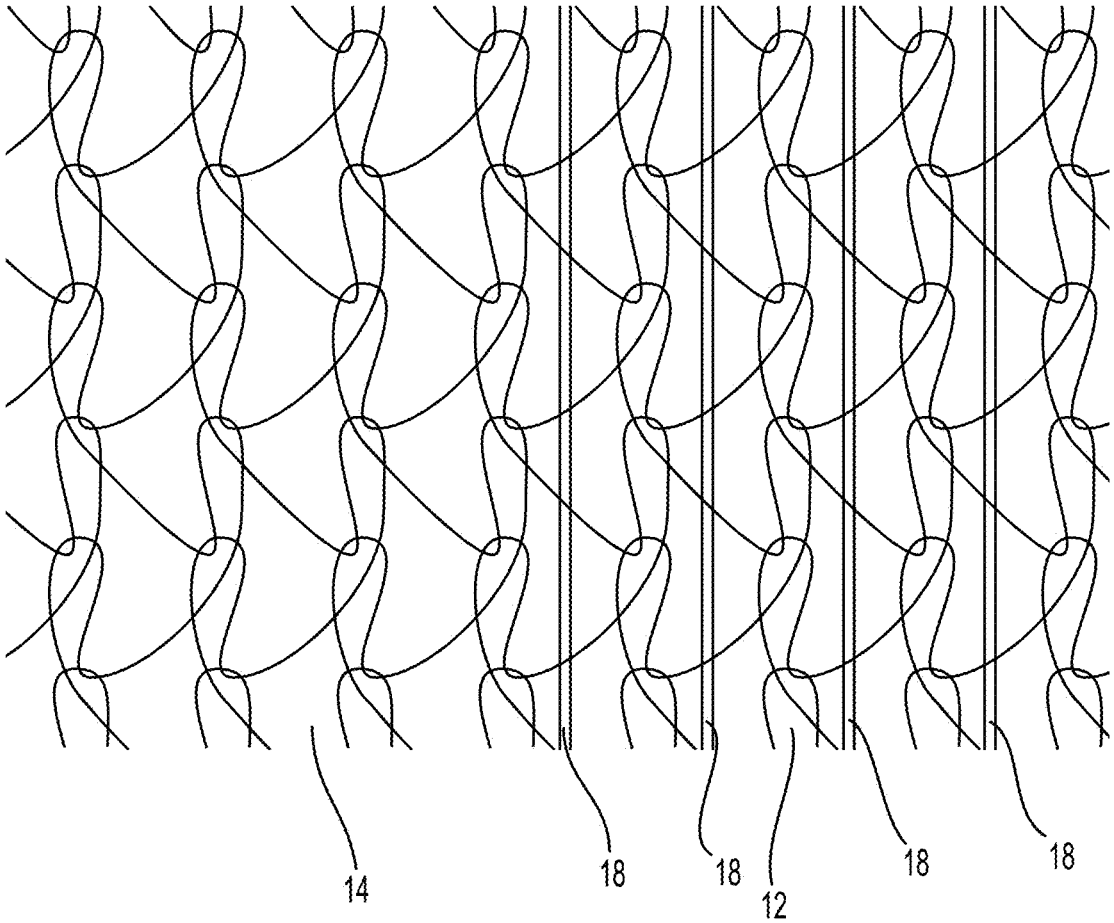
FIG. 16 illustrates a knit sheet according to the present invention having in-laid or sliver yarn.
Figure 17:
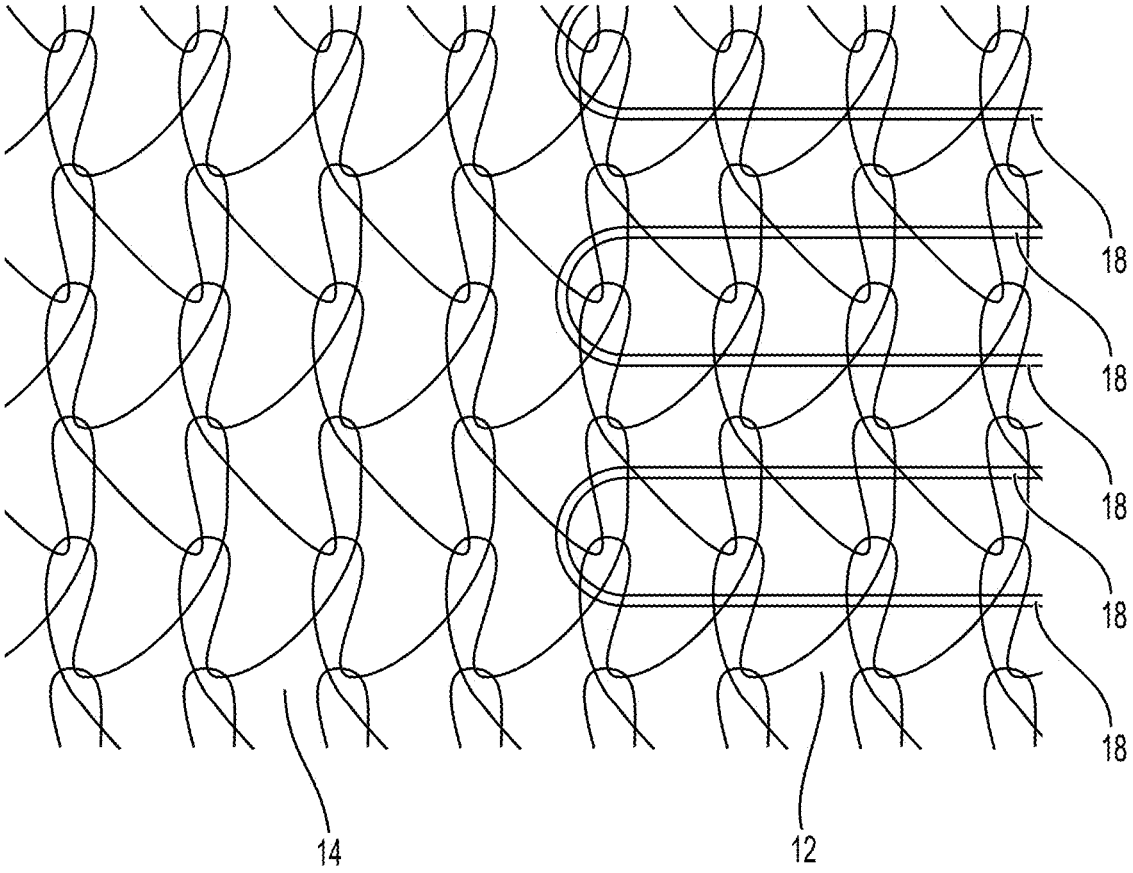
FIG. 17 illustrates a knit sheet according to the present invention having in-laid or sliver yarn.
Figure 18:
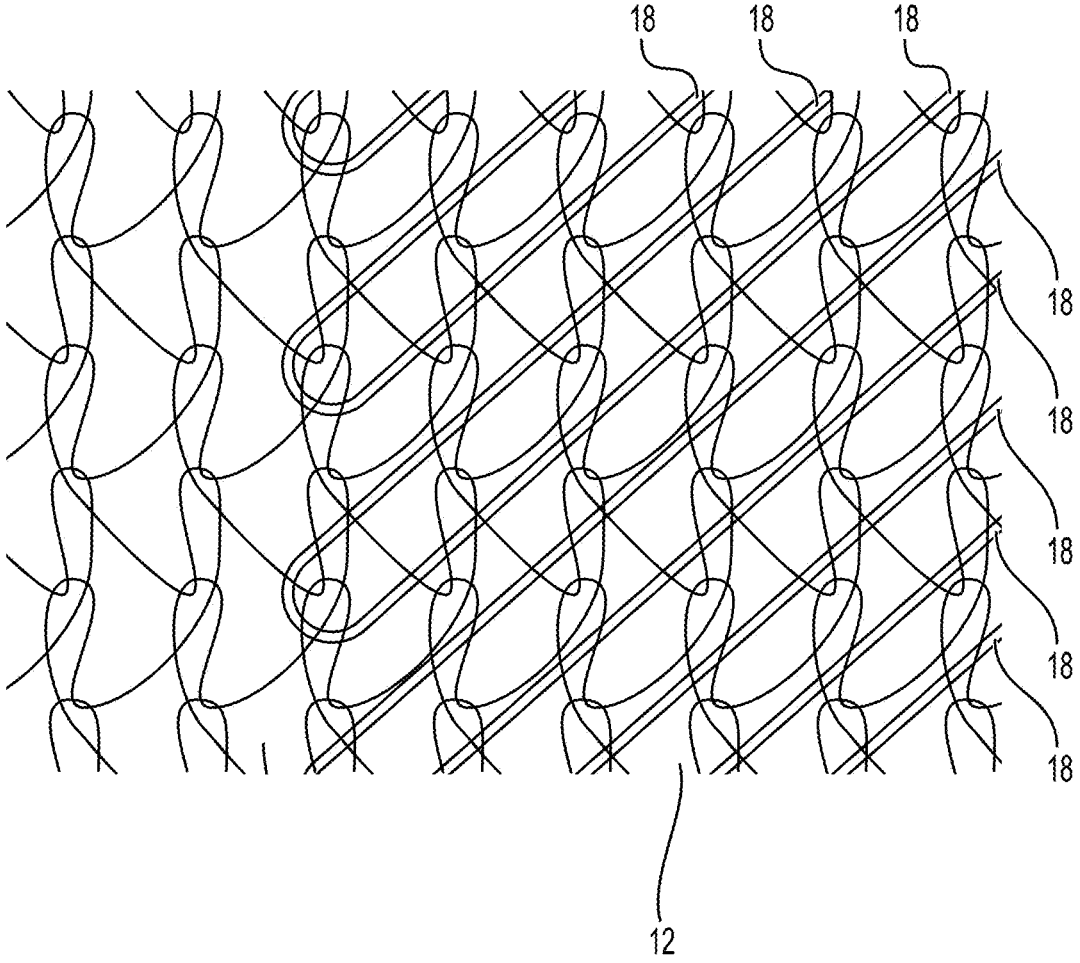
FIG. 18 illustrates a knit sheet according to the present invention having in-laid or sliver yarn.
Figure 19:
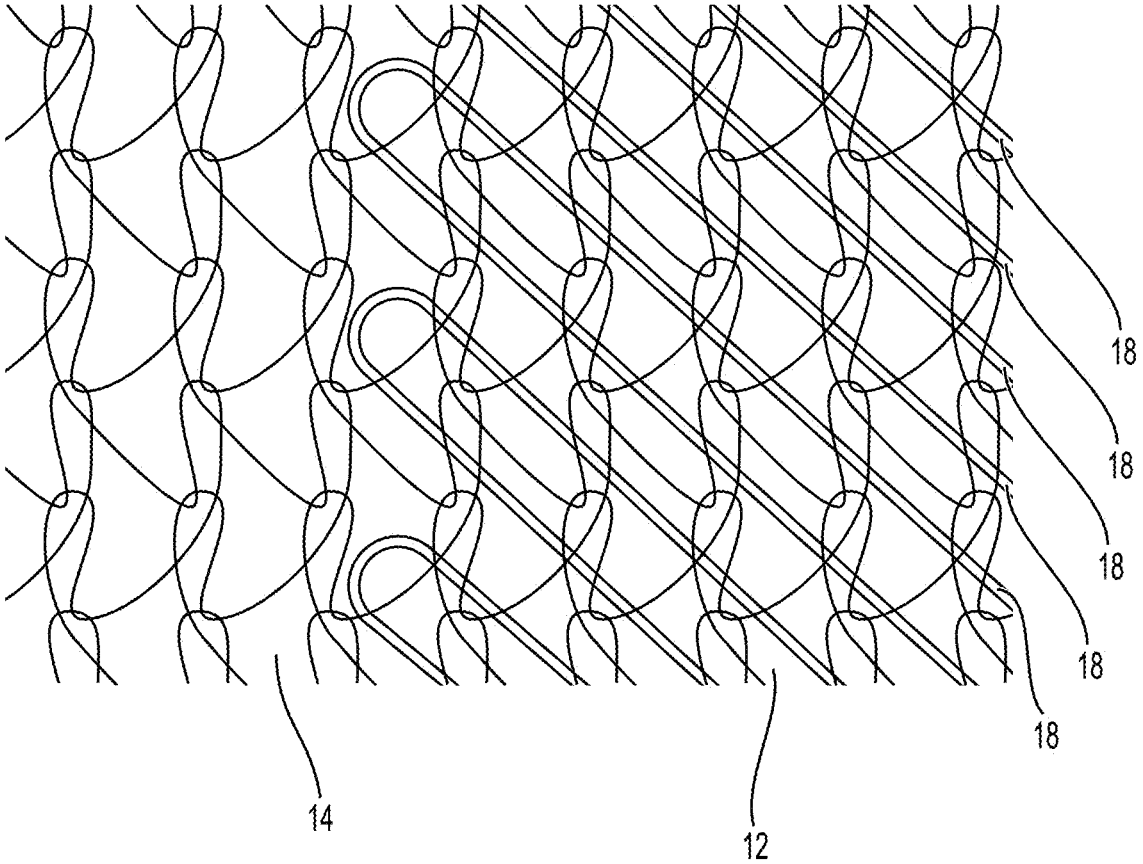
FIG. 19 illustrates a knit sheet according to the present invention having in-laid or sliver yarn.

As illustrated in FIGS. 6A to 6D and 15 to 19, in some embodiments the warm portion 12 comprises one set of in-laid yarn 18 and the cool portion 14 lacks in-laid yarns. For example, the warm portion 12 comprises at least one set of in-laid yarns 18 in the horizontal, vertical or angled at a diagonal direction and the cool portion 14 lacks in-laid yarns. In other embodiments, the warm portion 12 comprises two sets of in-laid yarns and the cool portion 14 lack in-laid yarns. In other embodiments, the warm portion 12 comprises two sets of in-laid yarns and the cool portion 14 comprises one set of in-laid yarns. In further embodiments, the warm portion 12 comprises three sets of in-laid yarns and the cool portion 14 lack in-laid yarns. In additional embodiments, the warm portion 12 comprises three sets of in-laid yarns and the cool portion 14 may comprise one set of in-laid yarns or two sets of in-laid yarns. In other embodiments, the warm portion 12 comprises four sets of in-laid yarns 18 and the cool portion 14 lack in-laid yarns. For example, as shown in FIG. 15, the warm portion 12 has four sets of in-laid yarn 18 in the horizontal, vertical and angled at diagonal directions and the cool portion 14 lacks in-laid yarns. In yet other embodiments, the warm portion 12 comprises four sets of in-laid yarns and the cool portion 14 may comprise one set, two sets, or three sets of in-laid yarns.

FIGS. 6A-6D, and FIGS. 15-19 each generally illustrate an exemplary knit non-seamed sheeting fabric 10 with in-laid or sliver yarn in the warm portion 12 of the fabric. The in-laid yarns extend in a both vertical and horizontal directions over more than one course and wale to reduce shrinkage and to balance the stretch in all directions of the sheeting fabric 10. For example, FIG. 15 illustrates a multi-axial warp knit. The cool portion 14 is a simple tricot stitch and lacks any sliver yarns. The warm portion 12 is a multi-axial knit produced on a modified raschel machine comprising sliver yarns 18 (e.g., the two sets of diagonal weft yarns, as well as the sets of yarn in the horizontal and vertical directions.). The sliver yarns are held together by a tricot or similar stitch. The diagonal weft insertions ensure parallel placement of yarns at a constant distance. The diagonal angle of weft yarns can be varied by altering the course density. FIGS. 16-19 illustrate additional knit sheets according to the present invention having in-laid yarns 18 in the warm portion of the sheets. The sheets at FIGS. 16-19 can be made in any suitable manner with any suitable machine. For example, the sheets at FIGS. 16-19. can be made with a multi-axial machine, but use of such a multi-axial machine is not necessary.

In accordance with another embodiment of the present invention, the non-seamed sheeting fabric includes a warm portion 12 and a cool portion 14, wherein each of the warm portion 12 and the cool portion 14 comprises the same number of sets of in-laid yarns, wherein the warm portion comprises a higher density in-laid yarn compared to the cool portion.

In-laid or sliver yarns provide advantages when used for sheeting fabrics compared to such yarns used for blanket fabrics. U.S. Patent Application Publication 2014/0115783 A1 discourages using a sliver knit construction because such a construction (e.g., a loose construction) may exhibit undesirable aesthetic appearances and shedding. However, Applicant has discovered that when sliver yarns are employed in accordance with the present invention, such undesirable characteristics may be minimized. The shedding of sliver or in-laid yarn may be reduced in sheeting fabrics by using a tight-knit construction, including but not limited to double-knits. According to the present invention, selecting an appropriate knit stitch(es) provides for fabrics with high numbers of yarn intersections or contact points that minimize shedding of the sliver yarn. In addition, the sliver yarns of the present invention, whether or not raised by brushing, shearing or sueding, are oriented parallel to the base fabric instead of isotropically oriented (generally extended perpendicular to the base fabric). Sliver yarns orientated parallel to the base fabric are significantly less likely to feel rough or prickly and thus have a more comfortable feel. This is especially advantageous when the non-seamed sheeting fabric of the present invention is used for a bed sheet because users apply their full body weight to yarn and yarn fibers when sleeping on top the sheet without the sensation of feeling pricked by the sheet.

For laid in embodiments, the added in-laid or sliver yarn preferably does not loop but is held in the loops to increase the density of the fabric. A denser fabric can be obtained with in-laid yarn because the amount of additional fiber is not limited by yarn size or by the distance between yarns. The in-laid yarn(s) can be extremely course, thick, irregular, crimped and/or less twisted than regular yarns. In-laid yarns can be left as uncut or partially cut loops, or sheared, brushed or sueded. Unlike woven fabric, fabric strength is not affected by these surface texturing processes. The quantity, thickness(es), densities, twist(s), ply, temperature-retaining capability, etc., of in-laid yarns are higher for the warm portion(s) 12 than the cool portion(s) 14. In-laid yarns that are better adapted to brushing, sueding or shearing are preferred for the warm portion(s) 12 than the cool portion(s) 14. Reinforced yarn(s) made, for example, from polyester instead of cotton may be utilized in the common course or wale yarn at the connection point(s) between the warm and cool portions 12 and 14 to increase the tensile properties of the sheeting fabric.

Warp knit machines can be adapted to introduce up to six additional sets of yarn. Guide bars on knit machines can lay in yarns with different angles as is known in the art. Multiple guide bars can be adapted to provide a multiaxial warp knit fabric with four or five sets of in-laid yarns, each having different orientations and variable angles. A multiaxial technique with multiple guide bars and supply packages was developed by Karl Mayer Textilmachinenfabrik GmbH and LIBA Maschienenfabrik GmbH. The Malimo technique can produce multi-axial knits by stitching layers of yarns or piles on a modified stitch bonding machine. These techniques, whether on a warp knitting device or on a special tricot machine using 5-7 in-laid yarn layers and a warp in-laid yarn layer, may be further adapted to provide fewer and/or lighter, thinner yarns or yarns with cooler fiber, etc. as before, for the cool portion(s) 14 than the warm portion(s) 12.

Weft insertion can be performed by a warp knitting machine with a weft laying attachment to carry at least one single filling yarn to and fro across the machine. More complex attachments supply at least one set of filling yarns to conveyors that travel to and fro across the machine. Flatbed machines can also be adapted to form floats or underlaps on the back of the fabric by the sideways movement of an additional set of warp yarns. One of the yarns is carried over three to six, or more, wales to form floats. The second set of yarns interloops with adjacent yarns. The long floats are broken when the fabric is sheared, sueded or brushed to yield a field of fiber hairs. Heavier yarns, coarse or low-twist yarn that adapts well to brushing can be used.

Like the woven counterparts, a further method introduces an extra set of yarn to form pile in a double-face or double fleece knit fabric. Made by knitting two layers of fabric face to face with a pile yarn connecting the two layers, the layers can be separated when the pile yarn is cut to yield two continuous lengths; the pile is formed by cutting the additional set of yarns that interlace the two fabrics. As the woven counterpart, the interlacing yarns are used primarily in the warm portion(s) 12, and the cool portion(s) 14 has relatively few or no interlacing yarns. Other variations of additional warp or weft yarns added to the base fabric, as disclosed in the woven counterparts, can be utilized in the knitted versions and fall within the scope of the present invention.

Figure 7A:
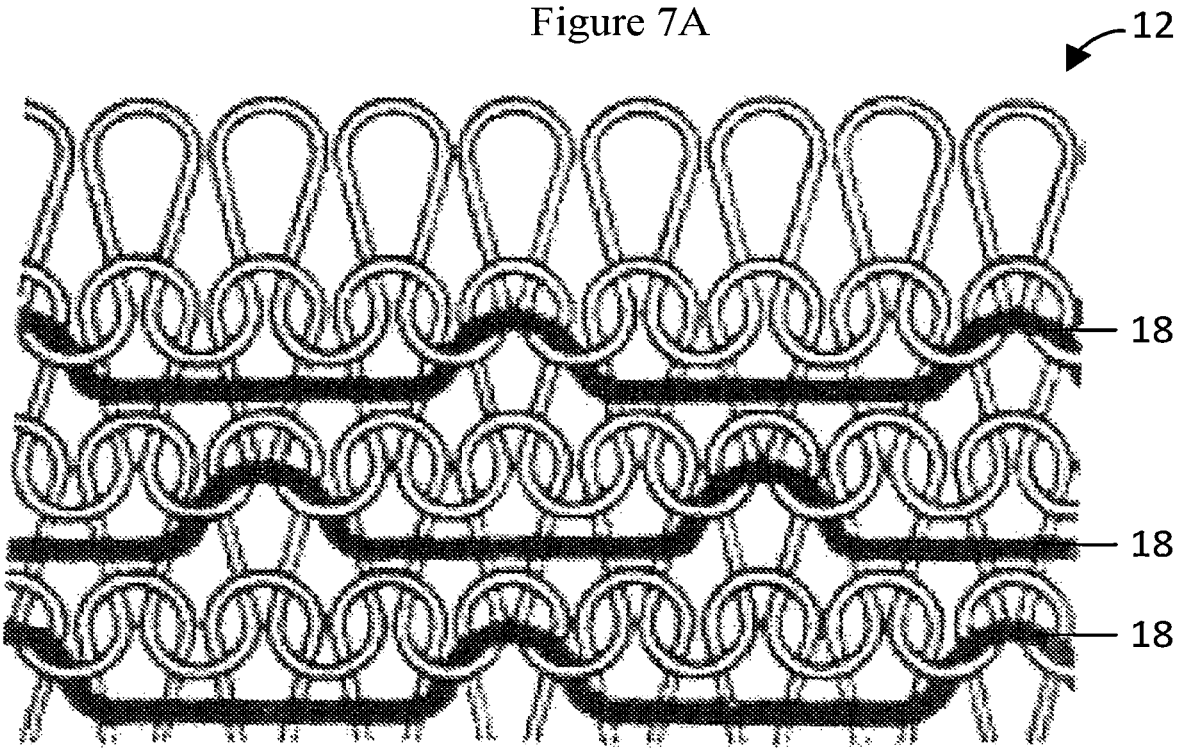
FIG. 7A and FIG. 7B illustrates a knit sheet according to the present invention having in-laid or sliver yarn.
Figure 7B:
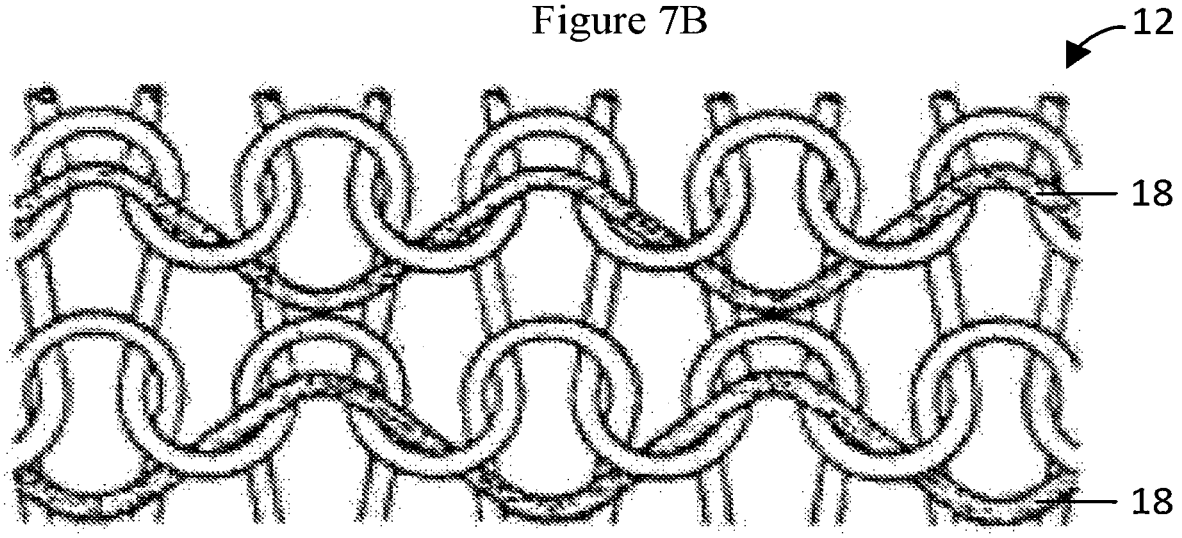

FIG. 7A and FIG. 7B (fleece fabric) illustrates weft-knitted jersey-based fabric containing non-knitted in-laid or sliver yarns incorporated into the ground fabric on a tuck-and-miss basis in course-wise direction which may be used as the warm portion of the sheeting fabric. It is contemplated but not shown that the in-laid yarns can be reversed in an alternating pattern, for example, a first and third sliver yarn may present more surface fiber to the technical face of the fabric whereas a second and fourth sliver yarn may present more surface fiber to the technical back of the fabric. Also not shown: non-knitted yarns eliminated, reduced in quantity, size, density, etc., for the cool portion(s).

Figure 8:
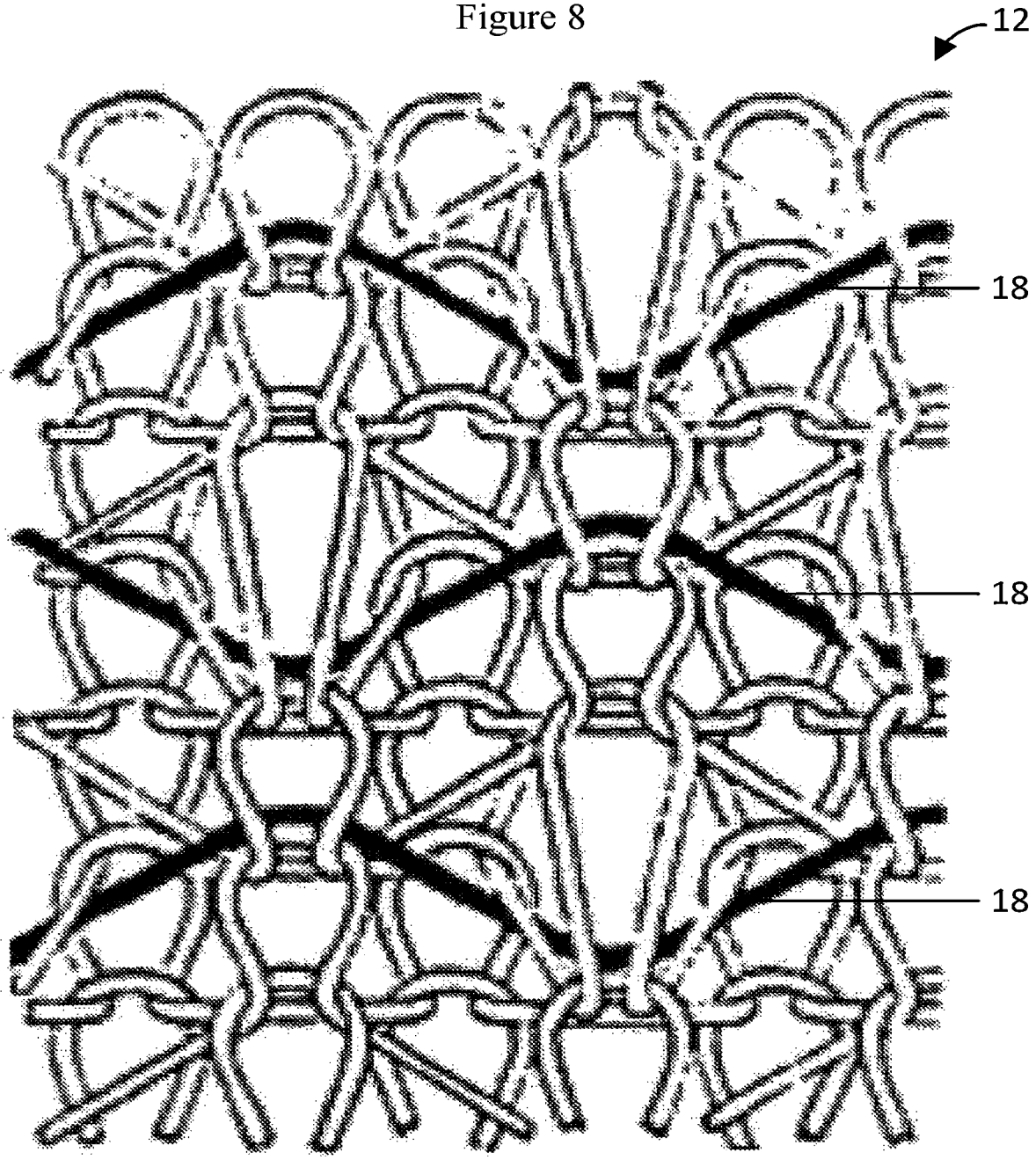
FIG. 8 illustrates a knit sheet according to the present invention having in-laid or sliver yarn.

FIG. 8 (weft-inlay stitch) illustrates generic weft-knitted rib-based fabric for the warm portion 12 containing course-wise non-knitted yarns that are either weft laid-in yarns held between the stitches of the face and of the reverse side, or laid-in yarns incorporated on a tuck-and-miss basis. It is contemplated but not shown that the in-laid yarns can be reversed in an alternating pattern, for example, a first and third sliver yarns may present more surface fiber to the technical face of the fabric whereas a second and fourth sliver yarn may present more surface fiber to the technical back of the fabric. Also not shown: laid-in yarns eliminated, reduced in quantity, size, density, etc., for the cool portions 14 of fabric 10.

Figure 9:
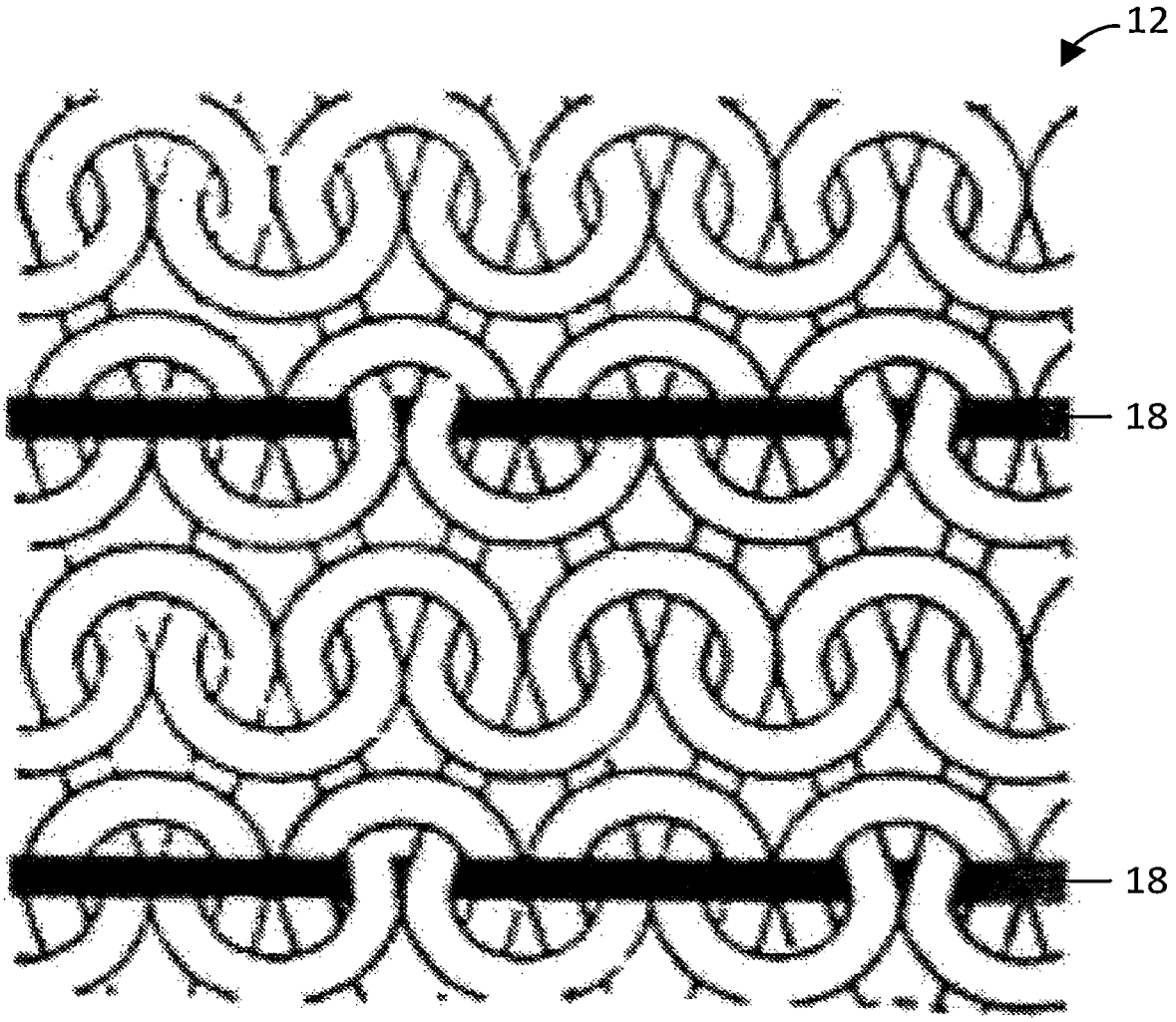
FIG. 9 illustrates a knit sheet according to the present invention having in-laid or sliver yarn.

FIG. 9 is the preferred knit construction of this invention, featuring a tightly-knit, least-shedding construction of sliver or in-laid yarns (laid-in fabric). This Figure illustrates generic weft-knitted jersey-based fabric for the warm portion 12 containing non-knitted yarns incorporated into the ground fabric on a tuck-and-miss basis in either course wise or coursewise/walewise direction. When the laid-in yarn is incorporated on a 1×3 tuck-and-miss basis, the fabric is known as ordinary laid-in fabric. It is contemplated but not shown that the in-laid yarns can be reversed in an alternating pattern, for example, a first and third sliver yarn may present more surface fiber to the technical face of the fabric whereas a second and fourth sliver yarn may present more surface fiber to the technical back of the fabric. Also not shown: laid-in yarns eliminated, reduced in quantity, size, density, etc., for the cool portion 14 of non-seamed sheeting fabric 10.

Figure 10:
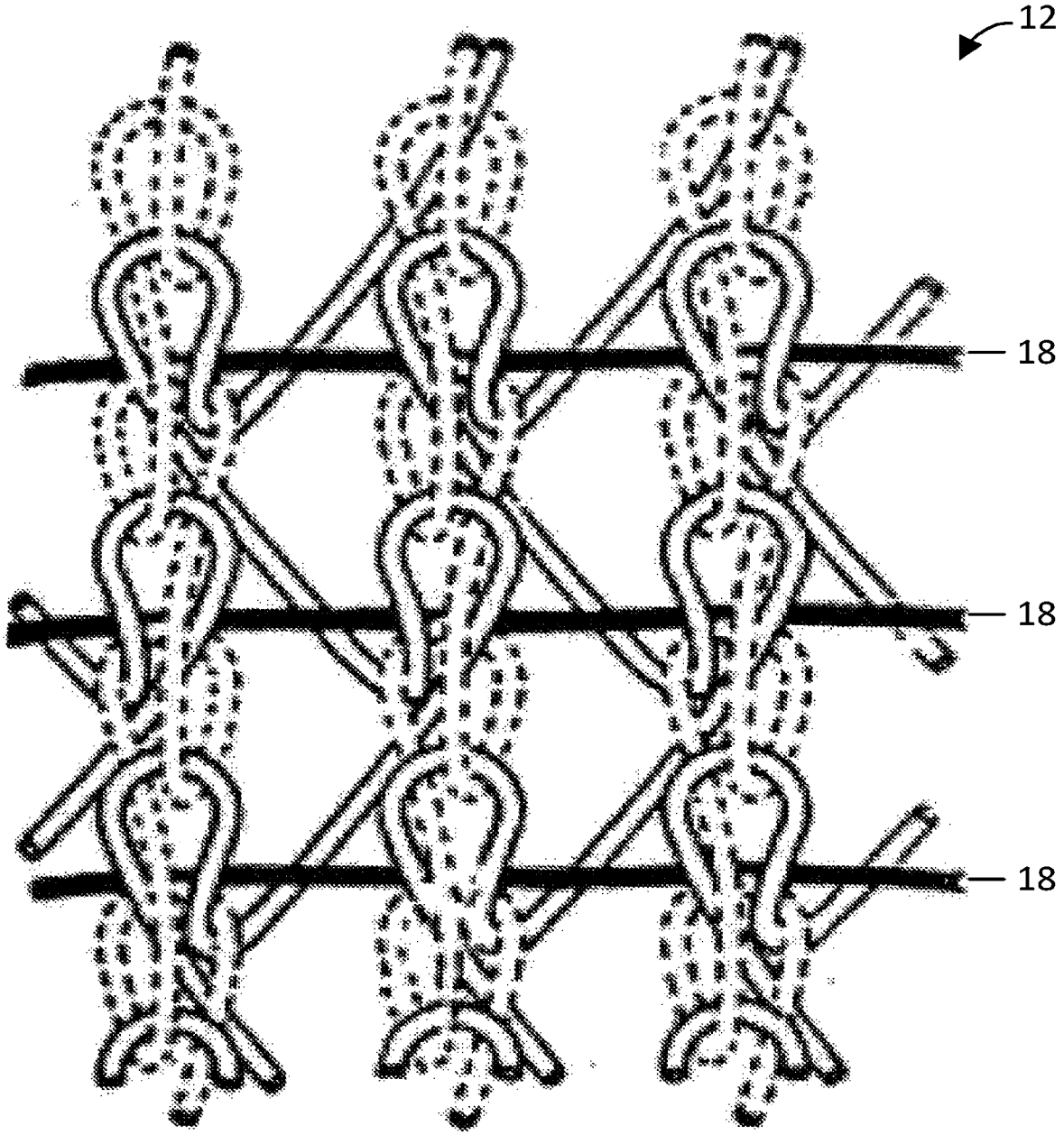
FIG. 10 illustrates a knit sheet according to the present invention having in-laid or sliver yarn.

FIG. 10 (weft-inlay fabric) illustrates warp knitted, purl-based fabric for the warm portion(s) 12 that contains weft-inlay yarns held between the face loops and the underlaps of the ground construction. If using a small tight stitch (high number of loops per inch) this construction is plausible for the cool portion due to significant air permeability. It is contemplated but not shown that the in-laid yarns can be reversed in an alternating pattern, for example, a first and third sliver yarn may present more surface fiber to the technical face of the fabric whereas a second and fourth sliver yarn may present more surface fiber to the technical back of the fabric. Also not shown: weft-inlay yarns eliminated, reduced in quantity, size, density, etc., for the cool portion 14 of fabric 10.

Figure 11:
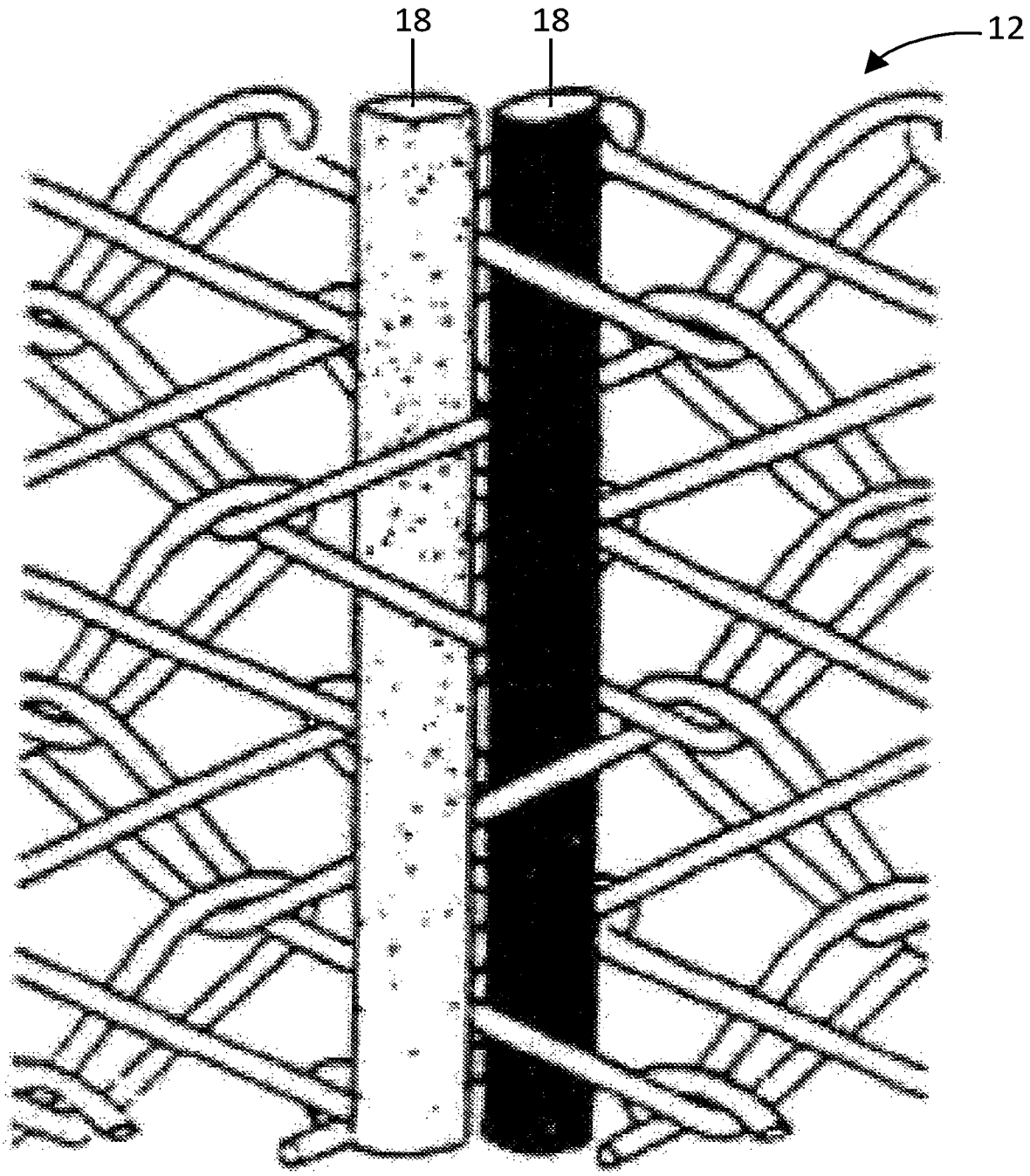
FIG. 11 illustrates a knit sheet according to the present invention having in-laid or sliver yarn.

FIG. 11 (vertical warp inlay fabric) illustrates warp-knitted jersey-based fabric for the warm portion(s) 12 containing in-laid pillar yarns incorporated in a substantially lengthwise direction in the fabric and held in position by parts of the stitches of the fabric. This could also be one component of multi-axial fabrics. The advantage to this construction is the increased tear strength in the lengthwise direction of the fabric. Not shown: in-laid yarns eliminated, reduced in quantity, size, density, etc., for the cool portion 14 of non-seamed sheeting fabric 10.

Figure 12:
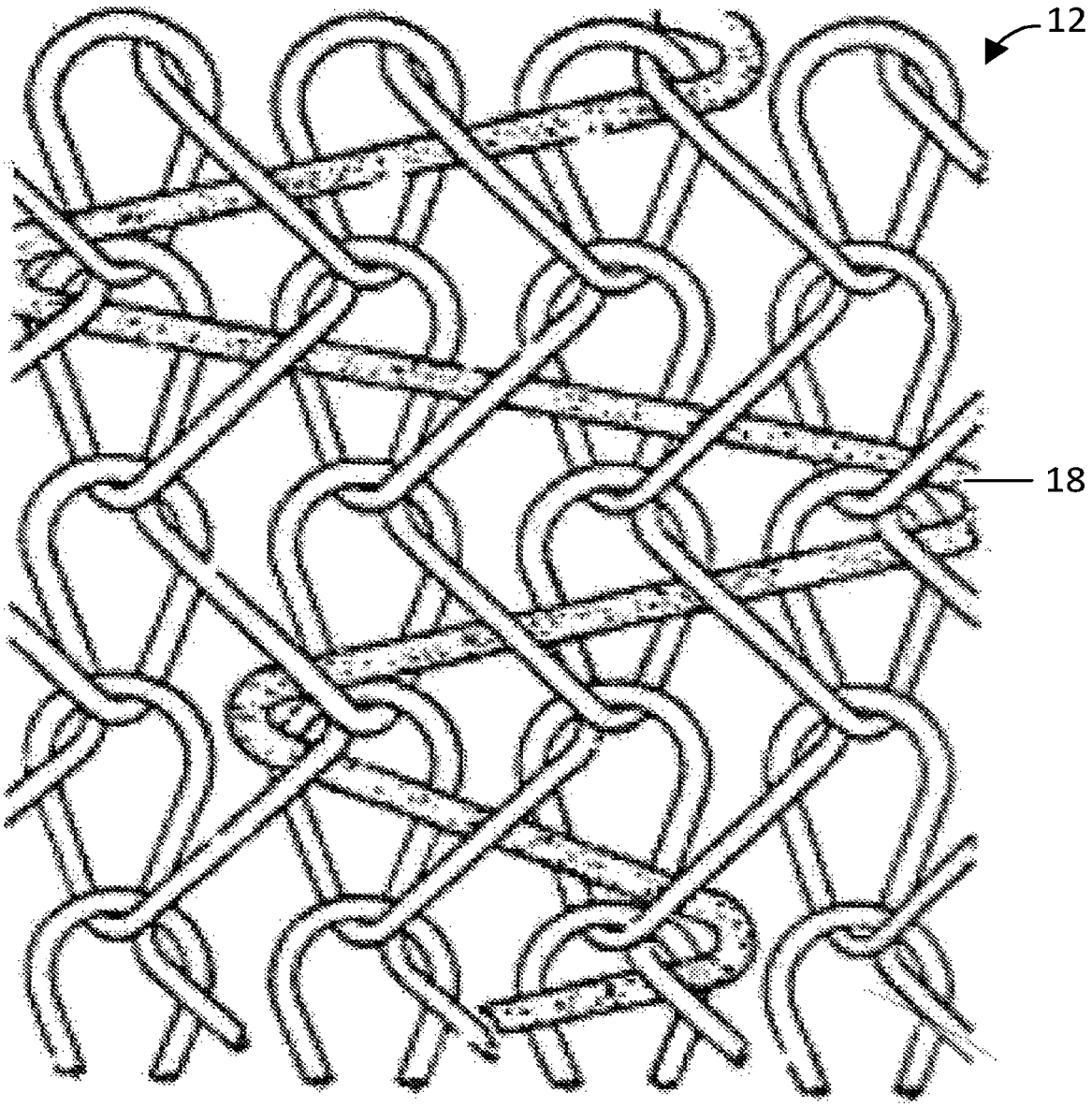
FIG. 12 illustrates a knit sheet according to the present invention having in-laid or sliver yarn.

FIG. 12 (warp-knitted laid-in fabric) illustrates warp-knitted jersey-based fabric for the warm portion(s) 12 that contains in-laid yarns positioned between the face loops and underlaps of the ground construction. The in-laid yarns extend in a non-symmetrical pattern over more than one wale providing the further advantage of balancing the stretch in both the horizontal and vertical directions of the sheeting fabric. In this warp knit embodiment, in-laid yarns run the length of the fabric and alternate across the width of the fabric. It is contemplated but not shown that the in-laid yarns can be reversed in an alternating pattern, for example, a first and third sliver yarn may present more surface fiber to the technical face of the fabric whereas a second and fourth sliver yarn may present more surface fiber to the technical back of the fabric. Also not shown: inlay yarns eliminated, reduced in quantity, size, density, etc., for the cool portion 14 of non-seamed sheeting fabric 10.

Figure 13:
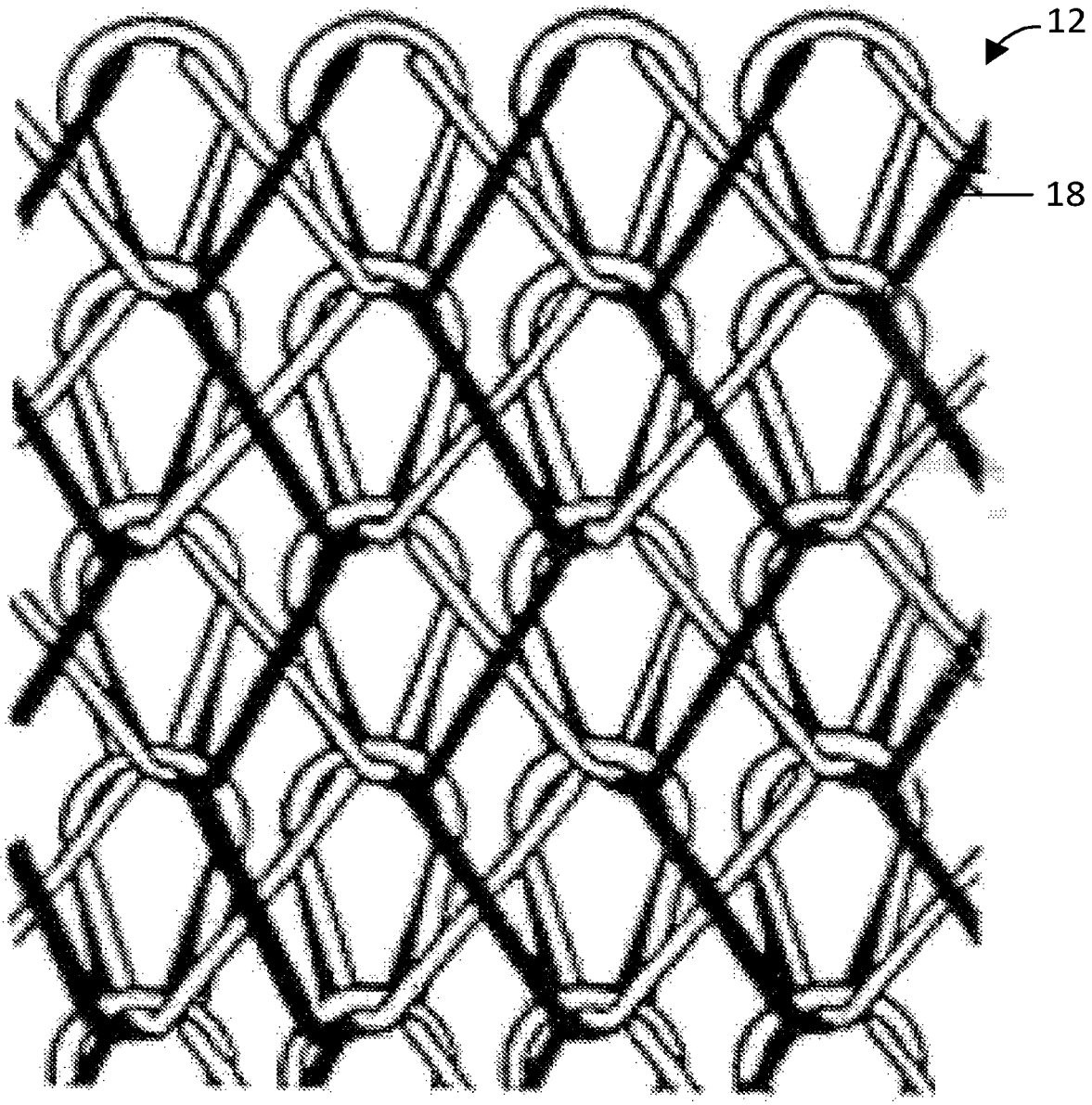
FIG. 13 illustrates a knit sheet according to the present invention having in-laid or sliver yarn.

FIG. 13 illustrates warp-knitted jersey-based (full or double tricot) fabric for the warm portion(s) 12 that consists of two systems of tricot stitches. The fabric can be made by tricot laps of two full sets of warp threads lapping in opposite directions on one set of needles. It is contemplated but not shown that the in-laid yarns can be reversed in an alternating pattern, for example, the first and third sliver yarn may present more surface fiber to the technical face of the fabric whereas a second and fourth sliver yarn may present more surface fiber to the technical back of the fabric. Also not shown: cool portions with warp threads reduced in quantity, size, density, etc., or one system of tricot stitches.

Figure 14:
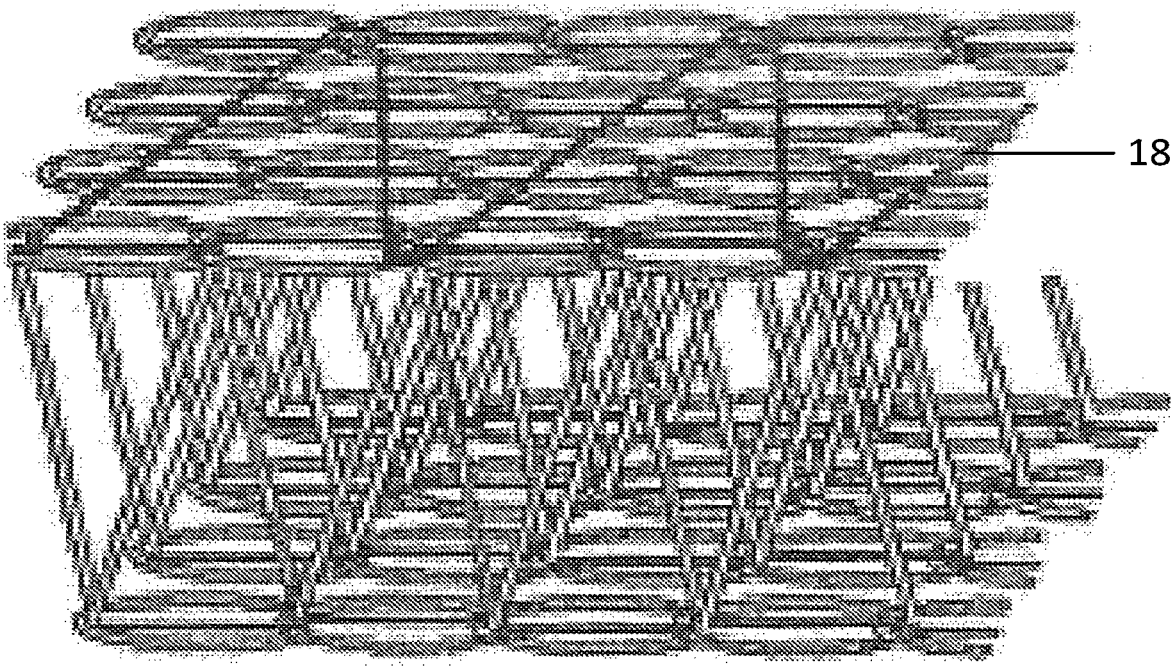
FIG. 14 illustrates a knit sheet according to the present invention having in-laid or sliver yarn.

FIG. 14 illustrates a double-layer fabric, which is a generic name applied to a range of double-layer jersey-based warp knitted fabrics. One layer can be entirely different from the other regarding the knit structure and type of fibers used. As with previous embodiments, the quantity of yarns used for the warm portion(s) is higher, and the yarns themselves typically thicker or denser than those utilized for the cool portion(s). Similarly, the warm portion(s) can utilize denser, thicker, higher or warmer fiber than the cool portion(s). Further, the weight and density of the base fabric can be different for the warm and cool portion(s). The multiple connecting threads between the two layers can be varied as to their length, frequency and physical characteristics. To produce on a double needle bar raschel machine, at least two guide bars knit one layer on one needle bar, another two guide bars knit the other layer, and two half-set threaded middle guide bars alternately lap over the needles of both needle bars to anchor the multiple connecting threads in the ground fabric. The in-laid yarn construction provides the advantage of a very smooth sheeting fabric and also very interesting and complex visual effects.

Tufting

Fabric with warm and cold portion(s), such as the non-seamed sheeting fabric 10 including warm portion 12 and cool portion 14, can be formed in any suitable manner in addition to those set forth above, such as by tufting. Tufting is a process of introducing extra yarns into a base fabric with a series of needles, each carrying at least one yarn. Commonly used for carpeting, the needles move simultaneously to pierce a base fabric at a predetermined length and form a loop as the needle is retracted. The quantity of loops per square inch, number of yarns per loop, height of tuft, yarn type, twist, plies and fiber used, etc.—elements that affect pile density—can vary for the warm and cool portion(s) 12 and 14. The base fabric, which can be woven, knitted or nonwoven can be different for the warm and cool portion(s) 12 and 14 as previously described. Tufted fabrics may be sheared, brushed or sueded as described below to amplify the thermal differences of the two portions of the fabric.

Flocking

The non-seamed sheeting fabric 10 including the warm and cool portions 12 and 14 can also be formed as a flocked fabric. To form a flocked fabric, natural or synthetic surface fiber is attached to a base fabric to create a pile. Flock fibers are applied by mechanical or electrostatic methods. Area flocking deposits flock on portions of the fabric and, as with previous embodiments, the warm portion(s) 12 can utilize denser, thicker, higher or warmer fiber than the cool portion(s) 14. Further, the weight and density of the base fabric can be different for the warm and cool portion(s) 12 and 14. Adhesive is used in the lamination method, wherein warm and cool portions are created by adhering fabrics by a wet or hot-melt adhesive or foam flame process. The adhesive, which can be foam, is applied to a face fabric(s) and joined to a liner fabric when pressed through pressure rollers. A sandwich consisting of an outer fabric, adhesive and the liner fabric may include two or more fabrics. The warm portion(s) can utilize fabric layers that are warmer than the cool portion(s) by varying the fiber, fabric density, pile height and other attributes as previously described. The number of layers for the cool portion(s) 14 can be fewer than those for the warm portion(s) 12. The foam can be denser for one portion than the other. Brushing, shearing, and sueding can be applied to the warm portion(s) and not to the cool portion(s) as subsequently disclosed.

Finishing

After the non-seamed sheeting fabric 10 is produced in any suitable manner such as by any of the processes described herein, it progresses to a series of continuous finishing processes. Fabric finishing processes typically include bleaching, washing, softening, shrinkage stabilization, water extraction, dyeing, surface texturing such as brushing, sueding, shearing, etc. At the start and end of each finishing process, the unfolded ("open-fabric") fabric is either wound in rolls or stacked. This is common practice for the intermediate transport and storage of the fabrics. Subsequent finishing equipment unwinds or unstacks the unfolded fabric before further processing.

Devices on most continuous finishing equipment are designed to work with fabrics that exhibit generally similar weights and thicknesses throughout the full width of the fabric. Difficulties arise when attempting to process a single fabric having significantly different weights and thicknesses, such as the non-seamed sheeting fabric 10. To overcome these difficulties, the fabric 10 can be finished by rope processing rather than open-fabric processing. Rope finishing is practiced by those skilled in fabric production although not for the reasons described herein. The rope fabric is opened and processed as open-width fabric for the final processing stages that include brushing, sueding and other processes.

Brushing, Shearing and Sueding

Surface texturing processes are less common finishing processes, but are typically required for fabrics with thermal characteristics such as the non-seamed sheeting fabric 10. These processes promote the thermal insulating effect of the fabric by filling the gaps between the yarns. Brushing, shearing, and sueding exaggerate the differences in the thermal insulation properties of the two fabrics in significant ways. For the non-seamed sheeting fabric 10 of the present invention, the warm portion(s) 12 is far more receptive and significantly more insulating when the fiber hair is raised.

A primary benefit of utilizing at least two constructions in a singular fabric is the relative accessibility of surface yarns for raising fiber pile. By providing a singular fabric with different constructions, significantly more insulating fiber hair can be raised for the warm portion(s) 12 compared to the cool portion(s) 14. Brushing, sueding and shearing devices cannot 'reach in' and grab highly interlaced yarns (of, for example, the plain weave), which is beneficial for the cool portion(s) 14 where minimal insulating pile is preferred. The relatively open structure of complex weaves or knits having in-laid yarns, provides for enhanced accessibility to the yarn surface and significantly more insulating fiber hair is raised for the warm portion(s) 12. For example, a 4/1 complex weave, where four yarns float over a single yarn, yields approximately four times more surface yarn accessibility compared to a 1/1 plain weave. Similarly for knit embodiments, the in-laid yarns provide an increased access to the surface of the yarns. The thermal differences between the warm and cool portion(s) 12 and 14 are accentuated and magnified preferably by the provision of at least two constructions, which diminish or augment the amount of pile raised for the respective portion(s), in a singular fabric.

One system of brushing involves passing the fabric over rotating cylinders, which are fitted with rows of tines that pluck fiber hairs from the fabric base. Sueding devices create a peach-type fuzziness on the surface of the fabric. Shearing exaggerates the different thermal insulation properties of the warm/cool portions by reducing the density and/or pile height of the fabric.

Figure 20:
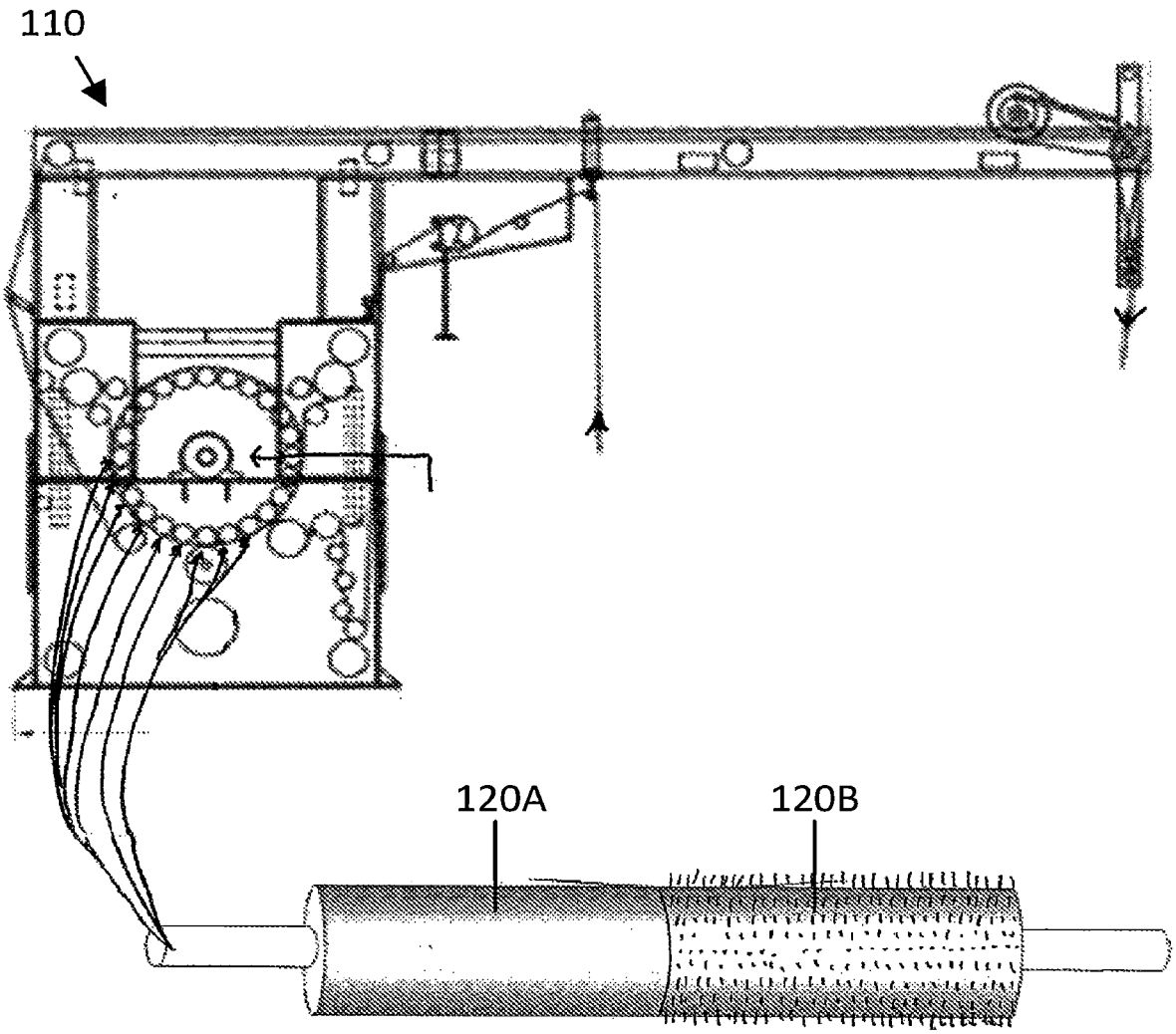
FIG. 20 illustrates an exemplary brushing machine according to the present invention.

Brushing, shearing and sueding devices can be configured to process the full width or only the warm portion(s) of the non-seamed sheeting fabric 10. FIG. 20 illustrates an exemplary brushing machine 110 according to the present invention including specially designed cylinders where the napping tines are included only on the section(s) 120B that brush the warm portion(s) 12 of the fabric; the cylinders are smooth 120A for the cool portion(s) 14. A different configuration achieves a similar result by physically separating, as by folding the fabric or by introducing space between the cool portion(s) away from the brushing cylinders while allowing the warm portion(s) to be exposed to the brushing cylinders. The fabric according to the present invention, such as the non-seamed sheeting fabric 10, can be brushed or sheared by folding the fabric and exposing only the warm portion(s) 12 to the napping cylinders, while the fold protects the cool portion(s) 14 from exposure. Similar adaptions to the sueding process are within the scope of the present invention.

Similarly, these surface texturing devices can be configured to process the base fabric more intensively for the cool portion(s) 14 than the warm portions 12. For example, the base fabric can be sheared closer for the cool portion(s) 14 and further from the base fabric for the warm portion(s) 12. It is a significant additional advantage of the present invention that fabric created with identical density or weight throughout the full width can be finished with surfacing texturing techniques to provide the warm and cool portions 14 and 12. Each above configuration ensures greater fabric density or more fiber hairs raised for the warm portion(s) 12 of the fabric than the cool portions(s) 14. The brushing, shearing and sueding processes can be applied as standalone or combined, and are not required for the non-seamed sheeting fabric 10 according to the present invention, although differences in the thermal insulation characteristics of the warm and cool portions 12 and 14, in both instant and overnight timeframes, may be reduced if such processes are not employed.

To achieve a totally versatile product, the hem or cuff is sized equally at the top and bottom of the fabric before it is sewn. This reversible sewing pattern allows for either (in the case of just two) the warm portion 12 or the cool portion 14 to be used on the right side or the left side of the bed, when the non-seamed sheeting fabric 10 is configured as a bed sheet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the invention of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A knitted sheeting fabric comprising:

a first lateral section extending across approximately one half of the width of the fabric, the first lateral section forming a warm portion; and a second lateral section extending across approximately the other half of the width of the fabric, the second lateral section forming a cool portion, wherein the first lateral section and the second lateral section are knit, wherein the first lateral section comprises a greater density of in-laid yarns than the second lateral section, and wherein the first lateral section and the second lateral section are integrally knitted within a single fabric.

2. The sheeting fabric of claim 1, wherein the first lateral section comprises at least two sets of in-laid yarns.

3. The sheeting fabric of claim 1, wherein the first lateral section comprises at least three sets of in-laid yarns.

4. The sheeting fabric of claim 1, wherein the first lateral section comprises at least four sets of in-laid yarns.

5. The sheeting fabric of claim 1, wherein the second lateral section is warp knit.

6. The sheeting fabric of claim 1, wherein the first lateral section is a raschel knit.

7. The sheeting fabric of claim 1, wherein the fabric is a warp knit.

8. The sheeting fabric of claim 1, wherein the fabric is a double knit.

9. The sheeting fabric of claim 1, wherein the fabric is a raschel knit.

10. The sheeting fabric of claim 1, wherein the fabric is configured as a bed sheet.

11. The sheeting fabric of claim 1, wherein the fabric is selected from the group consisting of a brushed fabric, a sueded fabric, a sheared fabric and combinations thereof.

12. The sheeting fabric of claim 1, wherein the fabric further comprises at least one reinforced yarn wherein said reinforced yarn is a polyester.

13. The sheeting fabric of claim 1, wherein the second lateral section has a greater porosity than the first lateral section.

14. The sheeting fabric of claim 1, wherein the second lateral section includes open spaces formed by needle skips.

15. The sheeting fabric of claim 2, wherein the two sets of in-laid yarns are oriented in different directions from each other.

16. A knitted bed sheet comprising:

a first lateral section extending across approximately one half of the width of the bed sheet; and a second lateral section extending across approximately the other half of the width of the bed sheet, wherein the first lateral section and the second lateral section are knit, wherein the first lateral section comprises a greater density of in-laid yarns than the second lateral section such that the first lateral section provides more thermal insulation than the second lateral section, wherein the first lateral section and the second lateral section are integrally knitted within a single fabric, and wherein the first lateral section and the second lateral section share at least one common course yarn.

17. The knitted bed sheet of claim 16, wherein the change in density between the first lateral section and the second lateral section is gradual.

18. The knitted bed sheet of claim 17, wherein the first lateral section comprises at least two sets of in-laid yarns.

19. The knitted bed sheet of claim 17, wherein the bed sheet comprises at least one reinforced yarn.

20. The knitted bed sheet of claim 16, wherein the second lateral section has a greater porosity than the first lateral section.

21. The knitted bed sheet of claim 16, wherein the second lateral section includes open spaces formed by needle skips.

22. The knitted bed sheet of claim 18, wherein the two sets of in-laid yarns are oriented in different directions from each other.

23. A knitted bed sheet comprising:

a first lateral section extending across approximately one half of the width of the bed sheet; and a second lateral section extending across approximately the other half of the width of the bed sheet, wherein the first lateral section and the second lateral section are knit, wherein the first lateral section comprises a greater density of in-laid yarns than the second lateral section such that the first lateral section provides more thermal insulation than the second lateral section, wherein the first lateral section and the second lateral section are integrally knitted within a single fabric, and wherein the first lateral section and the second lateral section share at least one common wale yarn.

24. The knitted bed sheet of claim 23, wherein the change in density between the first lateral section and the second lateral section is gradual.

25. The knitted bed sheet of claim 24, wherein the first lateral section comprises at least two sets of in-laid yarns.

26. The knitted bed sheet of claim 24, wherein the bed sheet comprises at least one reinforced yarn.

27. The knitted bed sheet of claim 23, wherein the second lateral section has a greater porosity than the first lateral section.

28. The knitted bed sheet of claim 23, wherein the second lateral section includes open spaces formed by needle skips.

29. The knitted bed sheet of claim 25, wherein the two sets of in-laid yarns are oriented in different directions from each other.

* * * * *